US008301073B2

(12) United States Patent
Ueda et al.

(10) Patent No.: US 8,301,073 B2
(45) Date of Patent: Oct. 30, 2012

(54) IMAGE FORMING APPARATUS, IMAGE FORMING SYSTEM INCLUDING THE SAME, AND STORAGE MEDIUM

(75) Inventors: Nobuyuki Ueda, Nara (JP); Shuhji Fujii, Kizugawa (JP); Yuji Okamoto, Kyoto (JP); Kenji Takahashi, Yamatokooriyama (JP); Kazuhiko Ido, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 1028 days.

(21) Appl. No.: 12/211,134

(22) Filed: Sep. 16, 2008

(65) Prior Publication Data

US 2009/0080001 A1 Mar. 26, 2009

(30) Foreign Application Priority Data

Sep. 26, 2007 (JP) ..... 2007-250047

(51) Int. Cl.
*G03G 15/00* (2006.01)
*G03G 21/14* (2006.01)
*B41J 29/38* (2006.01)

(52) U.S. Cl. ..... 399/401; 399/402; 271/270

(58) Field of Classification Search ..... 399/401, 399/397, 405; 271/270, 291
See application file for complete search history.

(56) References Cited

U.S. PATENT DOCUMENTS

| | | | | |
|---|---|---|---|---|
| 2002/0097428 | A1 * | 7/2002 | Ferlitsch | 358/1.15 |
| 2003/0210921 | A1 | 11/2003 | Ueda et al. | |
| 2004/0178572 | A1 * | 9/2004 | Nishimura et al. | 271/298 |
| 2004/0213610 | A1 * | 10/2004 | Yuasa | 399/401 |

FOREIGN PATENT DOCUMENTS

| | | |
|---|---|---|
| JP | 09-221254 | 8/1997 |
| JP | 2000-177902 | 6/2000 |
| JP | 2004-046037 | 2/2004 |
| JP | 2004-145218 | 5/2004 |
| JP | 2005-164711 | 6/2005 |
| JP | 2005-321482 | 11/2005 |
| JP | 2006-124125 | 5/2006 |

OTHER PUBLICATIONS

English machine translation of JP 2000-177902, which was published in the year 2000.*
English machine translation of JP 2004-046037, which was published in 2004.*
Machine translation of JP 2000-177902, which was published in the year 2000.*
Machine translation of JP 2004-046037, which was published in the year 2004.*
PTO-892 Aug. 31, 2011.*
PTO-892 Feb. 27, 2012.*

* cited by examiner

*Primary Examiner* — Judy Nguyen
*Assistant Examiner* — Ruben Parco, Jr.
(74) *Attorney, Agent, or Firm* — Renner, Otto, Boisselle & Sklar, LLP

(57) ABSTRACT

In an image forming apparatus of the present invention, when performing one-side printing during a predetermined period after two-side printing, a change in a carrying velocity of a post-process apparatus is prevented and thus recording paper having passed through a fixing section is carried and output at a velocity that is lower than a velocity for normal one-side printing and that is identical with a velocity for two-side printing. Consequently, it is possible to prevent dropping of productivity of the image forming system due to a time necessary for changing the carrying velocity of the post-process apparatus and to increase an operating ratio of the image forming system, even if the post-process apparatus is designed to completely stop the carrying roller etc. when changing the carrying velocity.

5 Claims, 10 Drawing Sheets

IMAGE FORMING APPARATUS, IMAGE FORMING SYSTEM INCLUDING THE SAME, AND STORAGE MEDIUM

This Nonprovisional application claims priority under U.S.C. §119(a) on Patent Application No. 250047/2007 filed in Japan on Sep. 26, 2007, the entire contents of which are hereby incorporated by reference.

FIELD OF THE INVENTION

The present invention relates to a technique for improving productivity of an image forming system in which an image forming apparatus is provided with a post-process apparatus.

BACKGROUND OF THE INVENTION

Conventional methods for outputting paper (recording material) from an image forming apparatus include: front surface paper output (hereinafter referred to as face-up paper output) in which paper is output with a printing face (face where an image is formed) facing up; and back surface paper output (hereinafter referred to as face-down paper output) in which paper is output with a printing face facing down. In the present specification, for convenience, "printing" indicates forming an image on paper.

In a case of an image forming apparatus in which face-up paper output is performed in outputting paper straight, when one-side printing is performed, paper is switched back so that front and back of the paper with respect to a paper carrying direction is inverted and the paper is subjected to the face-down paper output. This is because when a one-side printing job including plural pages is performed in the face-up paper output, the order of pages is inverted. When a two-side printing job including plural pages is performed, an image on a later page faces up in the face-up paper output, and consequently it is unnecessary to switch back the paper.

Paper is switched back by causing the paper to be carried via an inversion carrying route. The inversion carrying route is provided with a pair of inversion rollers that are rotatable forwardly and backwardly, and a carrying direction of paper in the inversion carrying route is inverted by backward rotation (see Patent Document 1 for example).

However, the face-down paper output involving such switchback requires a longer time for the paper to pass through a fixing section and to be output from the image forming apparatus, compared with the face-up paper output in which paper is output straight.

In order to deal with recent speeding up, some of image forming apparatuses in which paper is switched back and output with its face down in one-side printing are designed so that paper having passed through a fixing section is carried at a velocity higher than a process velocity that is a paper carrying velocity of an image forming section, and the paper is output at a velocity higher than a paper output velocity in two-side printing that is the same as the process velocity.

The image forming apparatus may be optionally connected with a post-process apparatus such as a staple apparatus and a sorter apparatus. The image forming apparatus connected with a post-process apparatus constitutes an image forming system (see Patent Document 2 for example).

The post-process apparatus causes paper output from the image forming apparatus to be carried into the post-process apparatus, carries out various post-processes on the paper, and loads the paper on a paper output tray. Examples of the post-process include stapling paper, outputting paper to a specified tray out of plural paper output trays, and offsetting an output position in the paper output tray.

As such an image forming system, Patent Document 3 discloses an arrangement in which a paper carrying velocity in a post-process apparatus changes in accordance with a paper output velocity of an image forming apparatus that changes in accordance with whether face-up paper output or face-down paper output (switchback is required) is carried out.

Patent Document 1: Japanese Unexamined Patent Publication No. Tokukaihei 09-221254 (published on Aug. 26, 1997)

Patent Document 2: Japanese Unexamined Patent Publication No. Tokukai 2005-321482 (published on Nov. 17, 2005)

Patent Document 3: Japanese Unexamined Patent Publication No. Tokukai 2006-124125 (published on May 18, 2006)

However, the Patent Document 3 arrangement in which a paper carrying velocity in the post-process apparatus continuously changes in accordance with a paper output velocity of the image forming apparatus requires a complex control of a velocity of paper carrying means of the post-process apparatus. Consequently, the arrangement requires high costs regardless of whether the arrangement is realized by hardware or software. Further, the arrangement requires a complex control, increasing a risk such as generation of troubles.

SUMMARY OF THE INVENTION

In order to solve the foregoing problems, there is proposed an arrangement in which a paper output velocity in the post-process apparatus does not change continuously, i.e. a control for temporarily and completely stopping a carrying roller and speeding up the carrying roller from zero to a predetermined velocity when changing a paper carrying velocity. Since the paper carrying velocity rises from zero, this arrangement allows much simpler control, lower costs, and lower risks, compared with an arrangement in which the paper carrying velocity changes from a certain velocity to another velocity.

However, this arrangement has a problem. Since the carrying roller stops completely, this arrangement requires a time for the carrying roller to stop and a time for the carrying roller to have a predetermined velocity, resulting in that a period during which the post-process apparatus cannot be used gets long.

In the period during which the post-process apparatus cannot be used, the image forming apparatus cannot form an image. Consequently, frequent changes in the paper output velocity drops productivity of an image forming system even when the image forming apparatus has a high processing velocity.

An object of the present invention is to provide an image forming apparatus, an image forming system, a program, and a storage medium, each of which allows increasing productivity of an image forming system including an image forming apparatus and a post-process apparatus.

In order to achieve the foregoing object, an image forming apparatus in accordance with a first aspect of the present invention is an image forming apparatus, provided with a post-process apparatus for performing a post-process on recording paper output from the image forming apparatus, the image forming apparatus and the post-process apparatus constituting an image forming system, the image forming apparatus including: an image forming section capable of two-side printing for forming images on both sides of the recording paper and one-side printing for forming an image on one side of the recording paper; a recording paper carrying section for, in the two-side printing, outputting the recording paper without switching back the recording paper, and for, in the one side-printing, switching back the recording paper and thereafter outputting the recording paper at a velocity higher than that for the two-side printing; printing process generation detection means for detecting generation of one of the one-side printing and the two-side printing that is performed within a predetermined period after the other of the one-side printing and the two-side printing; and first change-of-paper-output-velocity prevention means for controlling the recording paper carrying section or both of the recording paper carrying section and the image forming section so that the paper output velocity does not change, when the printing process generation detection means detects generation of said one of the one-side printing and the two-side printing.

With the arrangement, the printing process generation detection means detects generation of one of one-side printing and two-side printing that is performed within a predetermined period after the other of the one-side printing and the two-side printing. That is, the printing process generation detection means detects that the post-process apparatus operating at a velocity corresponding to a paper output velocity of one of the one-side printing and the two-side printing is in a state where the post-process apparatus will be instructed to operate at a velocity corresponding to a paper output velocity of the other of the one-side printing and the two-side printing.

When the printing process generation detection means detects that the post-process apparatus is in such a state, the first change-of-paper-output-velocity prevention means controls the recording paper carrying section or both of the recording paper carrying section and the image forming section so that the paper output velocity does not change.

Therefore, when the post-process apparatus requires a relatively long time to change a carrying velocity of recording paper and would have higher productivity without changing the carrying velocity, it is possible to prevent the post-process apparatus from unnecessarily changing the recording paper carrying velocity in accordance with a change in the paper output velocity of the image forming apparatus, thereby preventing drop in productivity of the image forming system and increasing an operating ratio of the image forming system.

In order to achieve the foregoing object, an image forming apparatus in accordance with a second aspect of the present invention is an image forming apparatus, provided with a post-process apparatus for performing a post-process on recording paper output from the image forming apparatus, the image forming apparatus and the post-process apparatus constituting an image forming system, the image forming apparatus including: an image forming section capable of two-side printing for forming images on both sides of the recording paper and one-side printing for forming an image on one side of the recording paper; a recording paper carrying section for, in the two-side printing, outputting the recording paper without switching back the recording paper, and for, in the one side-printing, switching back the recording paper and thereafter outputting the recording paper at a velocity higher than that for the two-side printing; page attribute information detection means for detecting page attribute information that is attached to image data per page included in a printing job, the page attribute information being one of front cover information, back cover information, and inserting paper information; and second change-of-paper-output-velocity prevention means for controlling the recording paper carrying section or both of the recording paper carrying section and the image forming section so that a paper output velocity of recording paper for the one-side printing in the printing job is identical with a paper output velocity of recording paper for the two-side printing, when the page attribute information detection means detects page attribute information.

The back cover information indicates that the image data is indicative of a back cover. The back cover is made by printing the back side of the recording paper and therefore processed in two-side printing. Therefore, the presence of the back cover information indicates that two-side printing will be required in order to complete the printing job.

The inserting paper information indicates that the image data is indicative of inserting paper. The inserting paper is made by printing the front side, the back side, or both sides of the recording paper and therefore may be processed in two-side printing. Therefore, the presence of the inserting paper information indicates that two-side printing may be required in order to complete the printing job.

The front cover information indicates that the image data is indicative of a front cover. The front cover is made by printing the front side of the recording paper and therefore processed in one-side printing. However, the presence of the front cover indicates the presence of the back cover that is processed in two-side printing.

With the arrangement, the page attribute information detection means detects the page attribute information such as front cover information, back cover information, and inserting paper information that is attached to image data per page included in a printing job and that indicates whether such two-side printing will be carried out or not.

When the page attribute information detection means detects the page attribute information, the second change-of-paper-output-velocity prevention means controls the recording paper carrying section or both of the recording paper carrying section and the image forming section so that a paper output velocity for image data in one-side printing included in the printing job is identical with a paper output velocity for image data in two-side printing included in the printing job.

Therefore, when the post-process apparatus requires a relatively long time to change a carrying velocity of recording paper and would have higher productivity without changing the carrying velocity, it is possible to prevent the post-process apparatus from unnecessarily changing the recording paper carrying velocity in accordance with a change in the paper output velocity of the image forming apparatus, thereby preventing drop in productivity of the image forming system and increasing an operating ratio of the image forming system.

In order to achieve the foregoing object, an image forming apparatus in accordance with a third aspect of the present invention is an image forming apparatus, provided with a post-process apparatus for performing a post-process on recording paper output from the image forming apparatus, the image forming apparatus and the post-process apparatus constituting an image forming system, the image forming apparatus including: an image forming section capable of two-side printing for forming images on both sides of the recording paper and one-side printing for forming an image on one side of the recording paper; a recording paper carrying section for, in the two-side printing, outputting the recording paper without switching back the recording paper, and for, in the one side-printing, switching back the recording paper and thereafter outputting the recording paper at a velocity higher than that for the two-side printing; printing job monitoring means for monitoring whether a spooled printing job sequence includes a printing job in one-side printing and a printing job in two-side printing and for predicting whether the number of changing a paper output velocity will be two or more; and third change-of-paper-output-velocity prevention means for changing an order of processing printing jobs so that one of the printing job in the one-side printing and the printing job in the two-side printing is given priority, when the printing job monitoring means predicts that the number of changing a paper output velocity will be two or more.

With the arrangement, the printing job monitoring means predicts whether the spooled printing job sequence includes a printing job in the one-side printing and a printing job in the two-side printing and the number of changing a paper output velocity will be two or more.

For example, when two-side printing job A, one-side printing job B, and two-side printing job C are spooled in this order, the printing job monitoring means predicts that the number of changing a paper output velocity will be two or more. The first two-side printing job A may be a job that is under processing.

When the printing job monitoring means predicts that the number of changing a paper output velocity will be two or more, the third change-of-paper-output-velocity prevention means changes the order of processing the printing jobs so that one of the one-side printing and the two-side printing is performed first.

That is, the order of the two-side printing job A, the one-side printing job B, and the two-side printing job C is changed to the order of the two-side printing job A, the two-side printing job C, and the one-side printing job B, or the order of the one-side printing job B, the two-side printing job A, and the two-side printing job C. When the first two-side printing job A is under processing, the order is changed to the order of the two-side printing job A, the two-side printing job C, and the one-side printing job B.

Consequently, the number of changing a paper output velocity changes from two to one, thereby reducing the number of changing a paper output velocity.

Therefore, when the post-process apparatus requires a relatively long time to change a carrying velocity of recording paper and would have higher productivity without changing the carrying velocity, it is possible to prevent the post-process apparatus from unnecessarily changing the recording paper carrying velocity in accordance with a change in the paper output velocity of the image forming apparatus, thereby preventing drop in productivity of the image forming system and increasing operating ratio of the image forming system.

Further, the present invention encompasses an image forming system including: any one of the image forming apparatuses in accordance with the first to third aspects of the present invention; and a post-process apparatus for performing a post-process on recording paper output from the image forming apparatus and for temporarily stopping a carrying roller when changing a recording paper carrying velocity in the post-process apparatus in accordance with a change in the paper output velocity of the image forming apparatus.

Each means of the image forming apparatus, i.e. the first to third change-of-paper-output-velocity prevention means, the printing process generation detection means, the page attribute information detection means, the printing job monitoring means, and the stopping detection means may be realized by hardware or may be realized by a computer executing a program. Specifically, in a storage medium in accordance with the present invention, a program for causing a computer to function as each means of the image forming apparatus is stored.

When a computer executes the program, the computer functions as the image forming apparatus. Therefore, as with the aforementioned image forming apparatuses, when this image forming apparatus is provided with a post-process apparatus to form an image forming system, it is possible to prevent unnecessary changes in the recording paper carrying velocity of the post-process apparatus and to prevent drop in productivity of the image forming system, thereby increasing operating ratio.

Additional objects, features, and strengths of the present invention will be made clear by the description below. Further, the advantages of the present invention will be evident from the following explanation in reference to the drawings.

DESCRIPTION OF THE EMBODIMENTS

Embodiment 1

With reference to FIGS. 1 to 7, the following explains one embodiment of the present invention.

Figure 2:
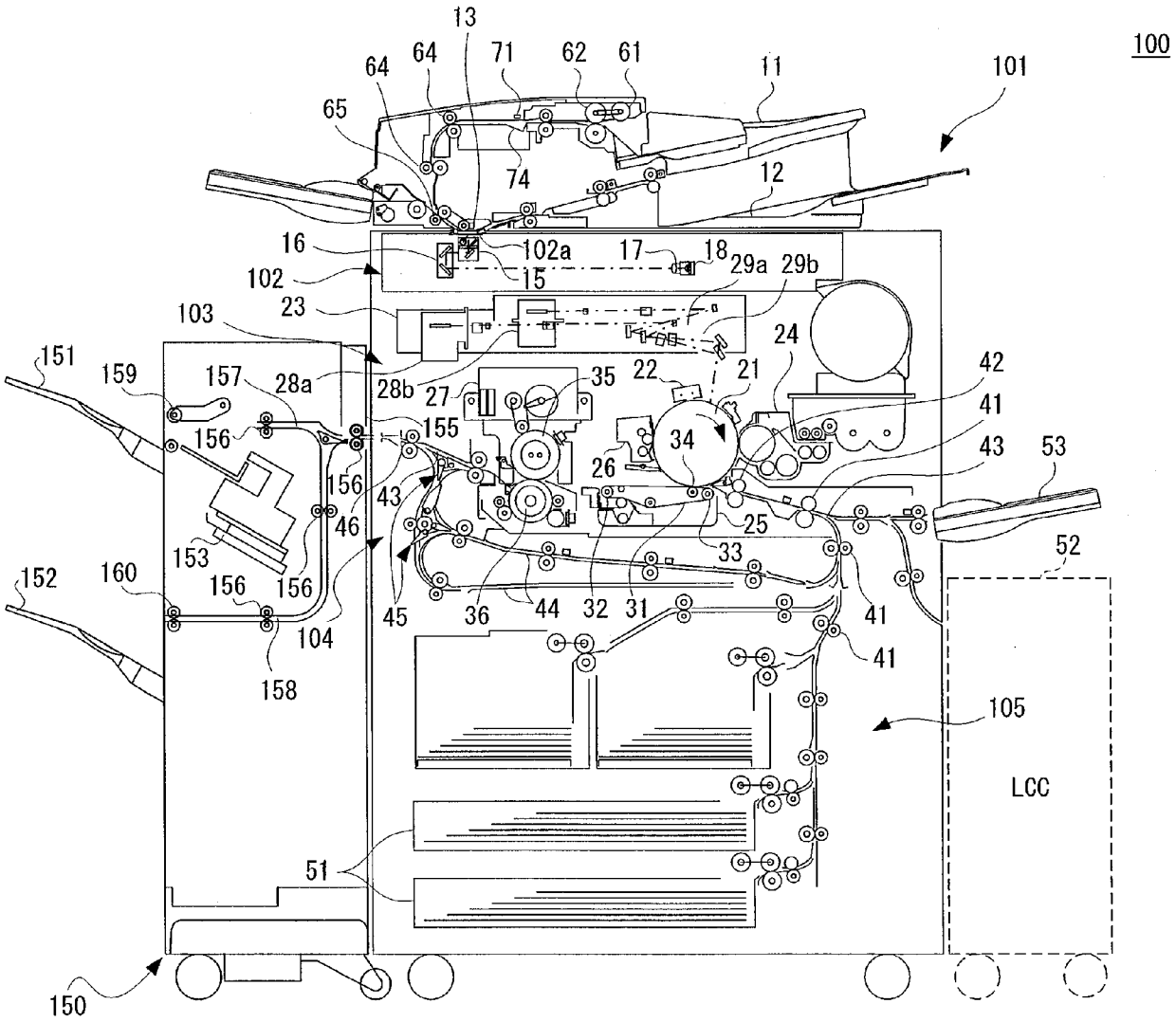
FIG. 2 is a drawing schematically illustrating a whole arrangement of an image forming system in accordance with Embodiments 1 to 3 of the present invention.

First, an explanation is made as to a whole arrangement of an image forming system of an embodiment of the present invention. FIG. 2 is a drawing schematically illustrating an arrangement of the image forming system of the present embodiment. The image forming system includes an image forming apparatus 100 and a post-process apparatus 150.

The image forming apparatus 100 obtains image data read out from a document or obtains image data received from an outside, and forms on paper (recording material, recording paper) a monochrome image indicated by the image data. The image forming apparatus 100 includes a document carrying section 101, an image reading section 102, a printing section (image forming section, process section) 103, a paper carrying section (recording paper carrying section) 104, and a paper feeding section 105.

In the document carrying section 101, when at least one document is set on a document setting tray 11, the document is drawn out of the document setting tray 11 and carried one by one, lead to a document reading window 102*a* of the image reading section 102 and passes through the document reading window 102*a*, and the document is output to a paper output tray 12.

A CIS (Contact Image Sensor) 13 is provided above the document reading window 102*a*. When the document passes through the document reading window 102*a*, the CIS 13 repeatedly reads an image of the back side of the document in a main scanning direction, and outputs image data indicative of the image of the back side of the document.

Further, when the document passes through the document reading window 102*a*, the document reading section 102 causes a lamp of a first scanning unit 15 to expose the surface of the document, causes a mirror of the first scanning unit 15 and a mirror of a second scanning unit 16 to lead light reflected from the surface of the document to an image focusing lens 17, and causes an image on the surface of the document to be focused on a CCD (Charge Coupled Device) 18 by the image focusing lens 17. The CCD 18 repeatedly reads the image on the surface of the document in a main scanning direction, and outputs image data indicative of the image on the surface of the document.

Further, when the document is put on a platen glass on the upper surface of the image reading section 102, the image reading section 102 causes the first and second scanning units 15 and 16 to move while keeping a predetermined relationship in velocity between the first and second scanning units 15 and 16, causes the first scanning unit 15 to expose the surface of the document on the platen glass, causes the first and second scanning units 15 and 16 to lead light reflected from the surface of the document to the image focusing lens 17, and causes an image on the surface of the document to be focused on the CCD 18 by the image focusing lens 17.

Image data output from the CIS 13 or the CCD 18 is subjected to various image processes by a control circuit such as a microcomputer, and is output to the printing section 103.

The printing section 103 records a document image indicated by image data on paper. The printing section 103 includes a photoreceptor drum 21, a charger 22, a light writing unit 23, a developer 24, a transfer unit 25, a cleaning unit 26, a fixing unit 27, and the like.

The photoreceptor drum 21 rotates in one direction. The surface of the photoreceptor drum 21 is cleaned by the cleaning unit 26 and then charged uniformly by the charger 22. The charger 22 may be a charger type or may be a roller type or a brush type that touches the photoreceptor drum 21.

The light writing unit 23 is a laser scanning unit (LSU) that includes laser irradiation sections 28*a* and 28*b* and mirror groups 29*a* and 29*b*. The light writing unit 23 receives image data, causes the laser irradiation sections 28*a* and 28*b* to irradiate laser lights corresponding to the image data so that the laser lights are irradiated to the photoreceptor drum 21 via the mirror groups 29*a* and 29*b* and expose the evenly charged surface of the photoreceptor drum 21, thereby forming an electrostatic latent image on the surface of the photoreceptor drum 21.

The light writing unit 23 employs a two-beam system in which the two laser irradiation sections 28*a* and 28*b* are provided in order to deal with high-velocity printing, thereby reducing workload due to speeding up of timing for irradiation.

Instead of the laser scanning unit, the light writing unit 23 may be an EL writing head or an LED writing head in which light-emitting elements are arrayed.

The developer 24 supplies a toner to the surface of the photoreceptor drum 21 and develops an electrostatic latent image, thereby forming a toner image on the surface of the photoreceptor drum 21. The transfer unit 25 transfers the toner image on the surface of the photoreceptor drum 21 to paper carried from the paper carrying section 104.

The fixing unit 27 heats and presses the paper to fix the toner image on the paper. Thereafter, the paper is further carried by the paper carrying section 104 to a paper output tray 47 and is output there. Further, the cleaning unit 26 removes and collects a toner remaining on the surface of the photoreceptor drum 21 after development and transfer.

The transfer unit 25 includes a transfer belt 31, a driving roller 32, a driven roller 33, an elastic conductive roller 34, and the like. The transfer belt 31 is suspended by the rollers 32 to 34 and other rollers to move endlessly. The transfer belt 31 has a predetermined resistance value (e.g. $1\times10^{9}$ to $1\times10^{13}$ Ω/cm) and carries the paper on the surface of the transfer belt 31. The elastic conductive roller 34 is pressed to the surface of the photoreceptor drum 21 via the transfer belt 31, and presses the paper on the transfer belt 31 to the surface of the photoreceptor drum 21. An electric field whose polarity is opposite to that of an electric charge of the toner image on the photoreceptor drum 21 is applied on the elastic conductive roller 34, and the electric field with the opposite polarity causes the toner image on the photoreceptor drum 21 to be transferred to the paper on the transfer belt 31. For example, when the toner image has an electric charge with negative polarity, an electric field applied on the elastic conductive roller 34 is set to have positive polarity.

The fixing unit 27 includes a heat roller 35 and a pressure roller 36. The heat roller 35 includes therein a heat source for setting the surface of the heat roller 35 to have a predetermined temperature (fixing temperature: approximately 160-200° C.). Further, in order that the pressure roller 36 is pressed to the heat roller 35 at a predetermined pressure, the heat roller 36 is provided with pressure members (not shown) at both sides of the pressure roller 36. When the paper is carried to a pressure area (referred to as a fixing nip area) between the heat roller 35 and the pressure roller 36, the heat roller 35 and the pressure roller 36 carry the paper while heating, fusing, and pressing the unfixed toner image on the paper, thereby fixing the toner image on the paper.

The paper carrying section 104 includes a main carrying route 43, an inversion carrying route 44, a plurality of diverging claws 45, plural pairs of carrying rollers 41 for carrying paper provided in each carrying route, a pair of resist rollers 42, a pair of paper output rollers 46, and the like.

The main carrying route 43 is a carrying route extending from the paper feeding section 105 to the paper output roller 46. The paper carrying section 104 receives paper from the paper feeding section 105 and carries the paper until an end of the paper reaches the resist roller 42. Since the resist roller 42 is temporarily stopped, the end of the paper reaches and touches the resist roller 42, and the paper is bent. An elastic force of the bent paper causes the end of the paper to be parallel to the resist roller 42. Thereafter, the resist roller 42 starts to be rotated so that the paper is carried to the transfer unit 25 of the printing section 103 and to the fixing unit 27.

Stopping and rotation of the resist roller 42 are made by switching on/off a clutch between the resist roller 42 and a driving axis and by switching on/off a motor that is a driving source for the resist roller 42.

Figure 4:
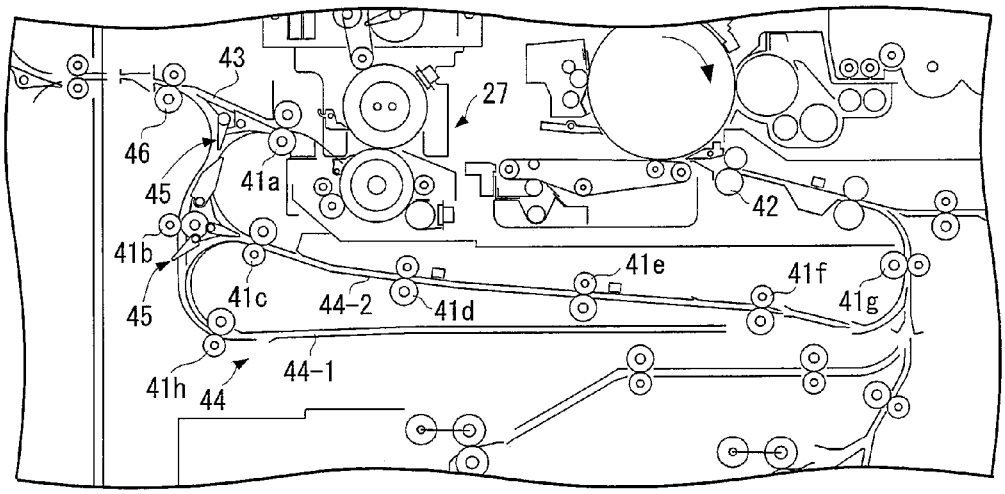
FIG. 4 is an enlarged drawing illustrating an arrangement of a main part of an inversion carrying route in the image forming apparatus in FIG. 2.

The inversion carrying route 44 is provided in such a manner as to diverge from the main carrying route 43. FIG. 4 is an enlarged drawing illustrating a main part of the inversion carrying route 44. The inversion carrying route 44 includes: an upper carrying route 44-2 that leads to the resist roller 42; and a lower carrying route 44-1 provided under the upper carrying route 44-2.

A diverging point of the main carrying route 43 and diverging points of the upper and lower carrying routes 44-2 and 44-1 of the inversion carrying route 44 are provided with the diverging claws 45, respectively.

In a case of two-side printing, the paper carrying section 104 causes the diverging claws 45 to rotate so that the diverging routes of the main carrying route 43 and the inversion carrying route 44 are switched and paper having passed through the fixing unit 27 is temporarily drawn into the lower carrying route 44-1 of the inversion carrying route 44. After the back end of the paper passes through a carrying roller 41*b*, a carrying roller 41*h* is inversely rotated so that the paper is switched back and goes back to the resist roller 42 of the main carrying route 43 via the upper carrying route 44-2. Thus, an image is formed also on the back side of the paper. After images are formed on both sides of the paper, the paper having passed through the fixing unit 27 is caused to go through the main carrying route 43 and is output by the paper output roller 46 to the outside of the image forming apparatus 100.

Further, in a case of one-side printing, the paper carrying section 104 causes the diverging claws 45 to rotate so that the diverging routes of the main carrying route 43 and the inversion carrying route 44 are switched and paper having passed through the fixing unit 27 is temporarily drawn into the lower carrying route 44-1 of the inversion carrying route 44. After the back end of the paper passes through the carrying roller 41*a*, the carrying rollers 41*b* and 41*h* are inversely rotated so that the paper is switched back and goes back to the main carrying route 43, and is output by the paper output roller 46 to the outside of the image forming apparatus 100. Thus, the paper that would have its face up if it were output straight is output with its face down.

The main carrying route 43 and the inversion carrying route 44 are provided with sensors for detecting the position of the paper etc., and the carrying roller 41 and the resist roller 42 are controlled to be driven in accordance with the position of the paper detected by the sensors, so that the carriage of the paper and the positioning of the paper are performed.

The paper feeding section 105 includes a plurality of paper feeding trays 51. Each paper feeding tray 51 is a tray for storing paper, and is provided under the image forming apparatus 100. Each paper feeding tray 51 includes a pick up roller etc. for drawing paper one by one, and feeds the drawn paper to the main carrying route 43 of the paper carrying section 104.

The image forming apparatus 100 of the present embodiment is designed for high-velocity printing. Therefore, each paper feeding tray 51 has a capacity capable of storing 500-1500 sheets of paper with a standard size.

Further, the image forming apparatus 100 is provided at its side with a manual tray 53 for mainly supplying paper with an indeterminate form. Further, as shown by a broken line in the drawing, the image forming apparatus 100 may be provided at its side with a large capacity paper feeding cassette (LCC) 52.

On the other hand, at a side of the image forming apparatus 100 which is opposite to the manual paper tray 53, a paper output tray is provided normally. Here, instead of the paper output tray, a post-process apparatus for performing a post-process on output paper is provided. Instead of the paper output tray, a multi-staged paper output tray may be optionally provided.

In the present embodiment, at the downstream side of the paper output roller 46 in the main body of the image forming apparatus 100, there is provided the post-process apparatus 150 to which a staple unit 153 is attached. The post-process apparatus 150 includes a paper receiving opening 155 that is positioned so as to correspond to a paper output opening of the image forming apparatus 100. The paper receiving opening 155 is provided with a pair of carrying rollers 156.

The paper output from the image forming apparatus is carried into the post-process apparatus 150 via the paper receiving opening 155 and is carried to a staple process carrying route 157 or a through-carrying route each provided with plural pairs of carrying rollers 156.

The staple process carrying route 157 is provided with the staple unit 153. Paper corresponding to one job is laminated in the order of output. When the paper corresponding to one job has been laminated completely, the paper is subjected to a staple process by the staple unit 153 to be one bundle, and then output by the paper output roller 159 onto the paper output tray 151. On the other hand, paper carried to the through-carrying route 158 is serially output by the paper output roller 160 onto the paper output tray 152.

Figure 3:
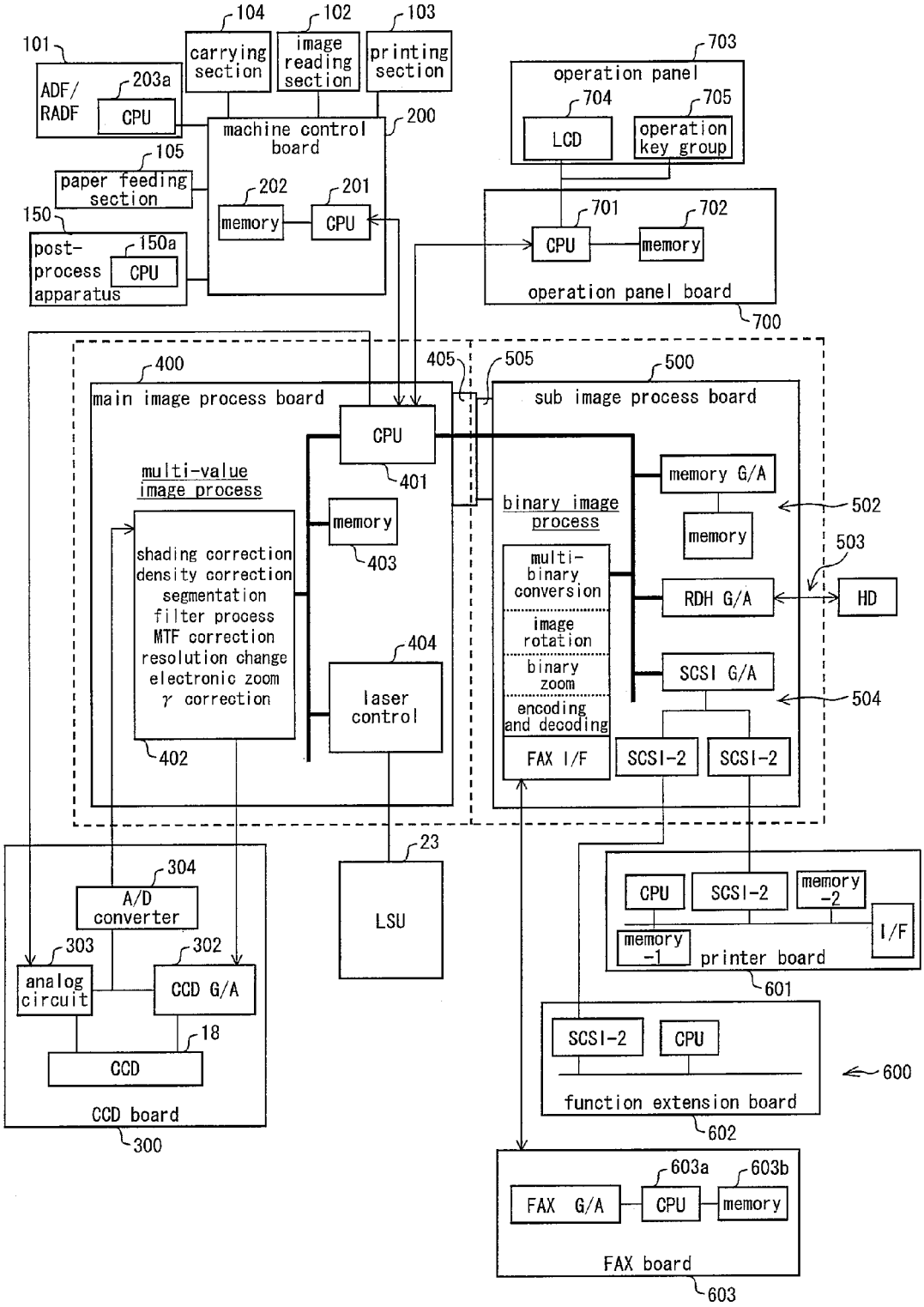
FIG. 3 is a drawing illustrating a whole block diagram of various unit sections and various image processing sections etc. that constitute an image forming system in accordance with Embodiments 1 to 3 of the present invention.

The following explains a control system of an image forming system of one embodiment of the present invention. FIG. 3 is a whole block diagram illustrating various unit sections and image processing sections that constitute the image forming system of the present embodiment. The drawing illustrates a state where a main central processing unit 401 (CPU) controls operation in combination with a sub central processing unit (CPU) provided in each unit section.

As illustrated in FIG. 3, the image forming system mainly includes: an operation panel board 700, provided substantially at the upper right of the drawing, for managing and controlling an operation panel 703; a machine control board 200, provided substantially at the upper left of the drawing, for managing and controlling each unit constituting the image forming apparatus 100; a CCD board 300, provided substantially at the lower left of the drawing, for electrically reading a document image and converting the document image to electronic data; a main image process board 400, provided substantially at the center of the drawing, for performing a predetermined image process on a document image having been converted to electronic data by the CCD board 300; a sub image process board 500, provided substantially at the center of the drawing, for further performing a predetermined image process on the image information processed by the main image process board 400; and other extension board group 600 (printer board 601, facsimile board 603, and function extension board 602), provided substantially at the lower right of the drawing, which is connected with the sub image process board 500 via an interface; and the like.

The following explains what is managed and controlled by each board.

(Operation Panel Board 700)

The operation panel board 700 is basically controlled by the sub central processing unit (CPU) 701, and manages a display screen of the LCD section 704 and an operational input via an operation key group 705 via which an instruction regarding each mode is input, the LCD section 704 and the operation key group 705 being provided on the operation panel 703.

The operation panel board 700 is provided with a memory 702 in which various control information for the operation panel, such information as data input via the operation key group 705 and information to be displayed on an LCD screen of the LCD section 704.

With the arrangement, the sub central processing unit (CPU) 701 performs control data communications with the main central processing unit (CPU) 401, and instructs an operation of the image forming apparatus 100.

Further, the main central processing unit 401 transfers a control signal indicative of an operation state of the image forming apparatus 100 to the sub central processing unit (CPU) 701, so that what state the image forming apparatus 100 is in is displayed to a user via the LCD section 704 of the operation panel 703.

(Machine Control Board 200)

The whole of the machine control board 200 is controlled by the sub central processing unit 201. The machine control board 200 manages: a document carrying section 101 such as ADF/RADF; an image reading section 102 for reading a document image; a printing section 103 for reproducing image data as an image; a paper feeding section 105 for serially feeding, from the paper feeding tray 51 etc., paper on which an image is to be recorded; a paper carrying section 104 for serially carrying the fed paper to the printing section 103 and for carrying the paper on which the image has been recorded by the printing section 103 to the paper output roller while inverting the front and back of the paper or switching back the paper, so that the paper is output; the post-process apparatus 150 for performing a post-process such as stapling on the paper on which the image has been recorded; etc.

(CCD Board 300)

The CCD board 300 includes: a CCD 18 for electrically reading a document image; a circuit (CCD gate array) 302 for operating the CCD 18; an analog circuit 303 for performing gain adjustment of analog data output from the CCD 18 or similar performance; an A/D converter 304 for converting an analog output from the CCD 18 into a digital signal and outputting the digital signal as electronic data; and the like. Control and management of the CCD board 300 are performed by the main central processing unit 401.

(Main Image Process Board 400)

The main image process board 400 is controlled by the main central processing unit 401, and includes: a multi-value image process section 402; a memory 403 in which various control information such as processed image data and management of procedure for the process is stored; a laser control section 404 for controlling data so that the data is transferred to the light writing unit 23 in order to reproduce an image based on the processed image information; and the like.

The multi-value image process section 402 performs processes such as shading correction, density correction, segmentation, a filter process, MTF correction, resolution conversion, electronic zoom (enlarging/reducing process), and gamma correction on electronic data indicative of a document image from the CCD board 300 while keeping the data as multi-value image data, so as to realize a desired tone reproducibility of an image.

(Sub Image Process Board 500)

The sub image process board 500 is connected with the main image process board 400 via a connector, and includes: a binary image process section 501 controlled by the main central processing unit 401 on the main image process board 400; a memory 502 in which binary image data having been subjected to an image process or control information for the process is stored and managed and a gate array for controlling the memory 502; a hard disc 503 in which a plurality of document image information is stored and managed and a desired number of a plurality of document images are repeatedly read out to produce a plurality of copies and a gate array for controlling the hard disc 503; an SCSI 504 and a gate array for controlling the SCSI 504; and the like.

The binary image process section 501 includes a process section for converting multi-value image data into a binary image, a process section for turning an image, a binary zooming process section for zooming up/down a binary image, and the like. Further, the binary image process section 501 includes a facsimile interface for transmitting/receiving a facsimile image via communication means.

(Extension Board 600)

Examples of the extension board 600 include: the printer board 601 for converting data from a personal computer etc. into data in a printer mode that can be output by the printing section 103 of the image forming apparatus 100; the function extension board 602 for extending an editing function of the image forming apparatus 100 and effectively utilizing features of the image forming apparatus 100; the facsimile board 603 for transmitting to the other side a document image read out from the image reading section 102 of the image forming apparatus 100 and for allowing the printing section 103 of the image forming apparatus 100 to output image information sent from the other side; and the like.

The following further details processes of image data and flows of image data that are performed by an image processing apparatus of the image forming apparatus 100 in a copy mode, a facsimile mode, and a printer mode.

(Copy Mode)

A document set at a predetermined position of the document carrying section 101 of the image forming apparatus 100 is serially supplied to the document reading window 102*a* of the image reading section 102 one by one, a document image is serially read by the CCD 18 or the CIS 13 that was mentioned before, and is transferred as 8-bit electronic data to the main image process board 400.

The 8-bit electronic data having been transferred to the main image process board 400 is subjected to a predetermined process at the multi-value image process section 402 as 8-bit electronic image data. Then, the 8-bit electronic image data is subjected to a process such as gamma correction, and is supplied to the light writing unit 23 made of the LSU via the laser control section 404.

Thus, the document image read by the image reading section 102 of the image forming apparatus 100 is output from the printing section 103 as a copy image with excellent tone reproduction.

(Electronic RDH Function in Copy Mode)

Similarly, a document set at a predetermined position of the document carrying section 101 of the image forming apparatus 100 is serially supplied to the document reading window 102*a* of the image reading section 102 one by one, a document image is serially read by the CCD 18 or the CIS 13 that was mentioned above, and is transferred as 8-bit electronic data for example to the main image process board 400.

The 8-bit electronic data having been transferred to the main image process board 400 is subjected to a predetermined process at the multi-value image process section 402 as 8-bit electronic image data.

The 8-bit electronic image data is transferred to the sub image process board 500 via a connector 405 of the main image process board 400 and a connector 505 of the sub image process board 500. Then, the 8-bit electronic image data is converted by a multi-binary conversion section of the binary image process section 501 into 2-bit electronic image data while being subjected to a process such as error diffusion.

The reason why the 8-bit electronic image data is converted into the 2-bit electronic image data while subjected to a process such as error diffusion is to reduce deterioration in image quality since performing only multi-binary conversion results in deterioration in image quality. The reason why the 8-bit electronic image data is converted into the 2-bit electronic image data is to reduce storage capacity required for an image.

The 2-bit electronic image data thus converted is transferred to the hard disc 503 such as a hard disc per one document and is temporarily stored and managed there.

When all of documents set at the predetermined position of the document carrying section 101 of the image forming apparatus 100 have been read, the 2-bit electronic image data temporarily stored in the hard disc 503 is repeatedly read out by a control of a gate array in the number of specified copies. The 2-bit electronic image data thus read out is transferred to the main image process board 400 via the connecters 405 and 505, is subjected to a process such as gamma correction, and is transferred to the light writing unit 23 via the laser control section 404.

Here, an explanation was made as to a case where all images of documents are read and thereafter a desired number of images are read out repeatedly. Alternatively, a first set of images may be serially output when a predetermined number of images are prepared.

Thus, a document image read out by the image reading section 102 of the image forming apparatus 100 is output by the printing section 103 as a copy image with excellent tone reproduction.

(Printer Mode)

Image data sent from an external apparatus such as a personal computer connected via a network is converted into image data per page on the printer board 601, and then temporarily transferred to the sub image process board 500 via the SCSI 504 that is an interface, and is stored in a memory such as the hard disc 503.

Note that the image data per page into which the image data sent from an external apparatus has been converted on the printer board 601 is transferred to the sub image process board 500 and temporarily stored in the hard disc 503 without being subjected to a binary image process.

Further, when the temporarily stored image per page is read out from the hard disc 503, the image per page is not subjected to the binary image process.

The image data temporarily stored in the hard disc 503 is read out from the hard disc 503 in such a manner that images are arranged in a predetermined order of pages, is sent to the main image process board 400, and is subjected to gamma correction, and the laser control section 404 controls the light writing unit 23 to reproduce an image.

(Facsimile Mode)

The facsimile mode includes a process for transmitting a document to the other end and a process for receiving a document from the other end.

First, an explanation is made as to the process for transmitting a document to the other end. A document to be transmitted is set at a predetermined position of the document carrying section 101 of the image forming apparatus 100 and the document is serially supplied to the document reading window 102*a* of the image reading section 102 one by one, a document image is serially read by the CCD 18 or the CIS 13 that was mentioned above, and is transferred as 8-bit electronic data to the main image process board 400.

The 8-bit electronic data having been transferred to the main image process board 400 is subjected to a predetermined process in the multi-value image process section 402.

The 8-bit electronic image data is sent to the sub image process board 500 via the connector 405 of the main image process board 400 and the connector 505 of the sub image process board 500, and is converted by the multi-binary conversion section of the binary image process section 501 into 2-bit electronic image data while being subjected to a process such as error diffusion in order to reduce deterioration in image quality.

The document is thus converted into a binary image and is encoded in a predetermined format to be stored in the memory 502.

After performing a transmission procedure with the other end and thus keeping a transmittable state, the image data of the document that has been encoded in the predetermined format and that has been read out from the memory 502 is transferred to the facsimile board 603, subjected to a necessary process such as a change of an encoding format on the facsimile board 603, and is serially transmitted to the other end via a communication line.

Next, an explanation is made as to a process for receiving a document image from the other end. When image data of a document is transmitted from the other end via a communication line, a transmission procedure is performed in the facsimile board 603 and image data indicative of a document is received from the other end. The received image data encoded in a predetermined format is sent to the binary image process section 501 via a facsimile interface provided in the binary image process section 501 of the sub image process board 500, and is decoded by an encoding/decoding process section to reproduce the document image transmitted as an image per page.

The document image reproduced as the image per page is transferred to the main image process board 400 and subjected to gamma correction, and the laser control section 404 controls the light writing unit 23 to reproduce an image.

The following explains a technique for increasing productivity of the image forming system of one embodiment of the present invention.

The image forming apparatus 100 included in the present image forming system allows a printing velocity of 100 sheets/min in one-side printing A4 portrait (paper carrying direction is a short side direction of the paper). In order to allow the printing velocity, the image forming apparatus 100 is designed so that different paper carrying velocities are set to each section.

A process velocity of the image forming apparatus 100 (peripheral velocity of the photoreceptor drum 21) is set to 540 mm/sec., and a velocity of paper carried from the resist roller 42 to the fixing unit 27 is set to 540 mm/sec. that is the process velocity. In contrast thereto, a velocity of paper carried from the paper feeding tray 51 to the resist roller 42 is set to, for example, 600 mm/sec. that is higher than the process velocity. Thus, the paper is speedily carried to the resist roller 42.

Further, a paper carrying velocity of the inversion carrying route 44 is set to a velocity different from the process velocity.

For example, a paper carrying velocity of a carrying route for switching back paper having passed through the fixing unit 27 and sending back the paper to the resist roller 42 again in two-side printing and a paper carrying velocity of a carrying route for switching back paper having passed through the fixing unit 27 and outputting the paper with its face down in one-side printing are set to 1000 mm/sec. Thus, the paper is speedily switched back and led to the printing section 103 or the paper output roller 46.

To be specific, in two-side printing, the carrying rollers 41*a*, 41*b*, and 41*h* illustrated in FIG. 4 draw the paper from the main carrying route 43 to the lower carrying route 44-1 at the velocity of 1000 mm/sec., and the carrying rollers 41*h*, 41*c*, 41*d*, 41*e*, and 41*f* send back the paper to the main carrying route 43 via the upper carrying route 44-2 at the velocity of 1000 mm/sec., and slow down the paper to have the velocity of 600 mm/sec. that is the same as the paper carrying velocity of the paper feeding section 105 with timing when an end of the paper reaches the carrying roller 41*g*.

A paper carrying velocity of a carrying route via which the paper having passed through the fixing unit 27 is output to the outside after forming an image on a back surface (second surface) of the paper is set to 540 mm/sec. that is the same as the process velocity. The carrying roller 41*a* and the paper output roller 46 carry the paper to the outside at a velocity that is the same as the process velocity.

On the other hand, in one-side printing, the carrying rollers 41*a*, 41*b*, and 41*h* illustrated in FIG. 4 draw paper from the main carrying route 43 to the lower carrying route 44-1 at a velocity of 1000 mm/sec., and the carrying rollers 41*h* and 41*b* switch back the paper at a velocity of 1000 mm/sec., and velocities of the carrying rollers 41*h* and 41*b* are speeded up to 600 mm/sec. that is higher than the process velocity of 540 mm/sec. with timing when an end of the paper reaches the paper output roller 46, and the carrying rollers 41*h* and 41*b* in combination with the paper output roller 46 carry and output the paper to the outside at the velocity of 600 mm/sec.

The reason why the paper output velocity in one-side printing is set to be higher than the process velocity is that outputting paper at the process velocity results in overlapping between a back end of paper and a front end of next paper. Setting the paper output velocity to be higher than the process velocity ensures a sufficient distance between the paper and the next paper.

The image forming apparatus 100 is provided with the post-process apparatus 150 having two paper carrying velocities corresponding to two paper output velocities of the image forming apparatus 100 that switch according to whether a printing mode is two-side printing or one-side printing. The paper output velocity of the image forming apparatus 100 changes according to whether the printing mode is two-side printing or one-side printing, and the paper carrying velocity of the post-process apparatus 150 changes according to the change of the paper output velocity of the image forming apparatus 100.

However, as described above, when the post-process apparatus is designed to continuously change the paper carrying velocity without stopping rotation of the paper carrying roller etc., a complex control of velocities is required for paper carrying means of the post-process apparatus. This requests high costs and results in high risks such as malfunction.

Therefore, the post-process apparatus 150 of the image forming system of the present embodiment is designed so that when changing a carrying velocity of the paper, rotation of the carrying roller 156 is completely stopped and then the carrying velocity of the carrying roller 156 is increased from zero to a predetermined velocity. Since the carrying velocity of the carrying roller 156 is increased from a state where the carrying roller 156 stops completely to a process velocity, it is possible to make a control of the carrying roller 156 much simpler, to reduce costs, and to reduce risks, compared with a design in which the velocity of the carrying roller changes from a state where the carrying roller rotates with a certain velocity to another velocity.

However, since the carrying roller 156 stops completely in the post-process apparatus 150, it takes 20 to 30 minutes to change the carrying velocity, and meanwhile the post-process apparatus 150 is out of operation.

Therefore, employing such arrangement of the post-process apparatus 150 without any plan would result in inconvenience such that the post-process apparatus 150 would get out of operation every time the printing mode would change from one-side printing to two-side printing or from two-side printing to one-side printing, which would drop productivity of the image forming system. In view of this problem, the image forming system of the present embodiment is designed so that operation of the paper carrying section 104 or operations of the paper carrying section 104 and the printing section 103 can be controlled in order to reduce the number of changes in the paper output velocity of the image forming apparatus 100 according to changes in the printing mode.

Specifically, when a printing process generation detection section (printing process generation detection means) detects generation of a printing process that is one of one-side printing and two-side printing performed within a predetermined period after the other of one-side printing and two-side printing is performed, a first change-of-paper-output-velocity prevention section (first change-of-paper-output-velocity prevention means) controls the paper carrying section 104 or both of the paper carrying section 104 and the printing section so that a paper output velocity is not changed.

To be more specific, the central processing unit 401 of the main image process board 400 serves as a printing process generation detection section and a first change-of-paper-output-velocity prevention section. When image data for one-side printing is transmitted as next printing data while performing two-side printing, the central processing unit 401 controls operation of the paper carrying section 104 so that paper is switched back and output from the image forming apparatus 100 not at a high velocity set for one-side printing but at a velocity set for two-side printing (hereinafter referred to as low velocity paper output).

Switching back the paper and outputting the paper at a low velocity indicates that, in normal one-side printing, paper is switched back by the carrying rollers 41*h* and 41*b* in FIG. 4 at 1000 mm/sec. and then carried at 600 mm/sec. that is higher than the process velocity of 540 mm/sec. with timing when an end of the paper reaches the paper output roller 46, whereas in this case, the paper is carried at 540 mm/sec. that is the process velocity.

Further, when image data for two-side printing is transmitted as next printing data while performing one-side printing, the central processing unit 401 controls the printing section 103 and the paper carrying section 104 so that images on front and back sides of paper in two-side printing are printed upside down with respect to each other and after the two-side printing, the paper is switched back and output at a high velocity just like the one-side printing.

Figure 5:
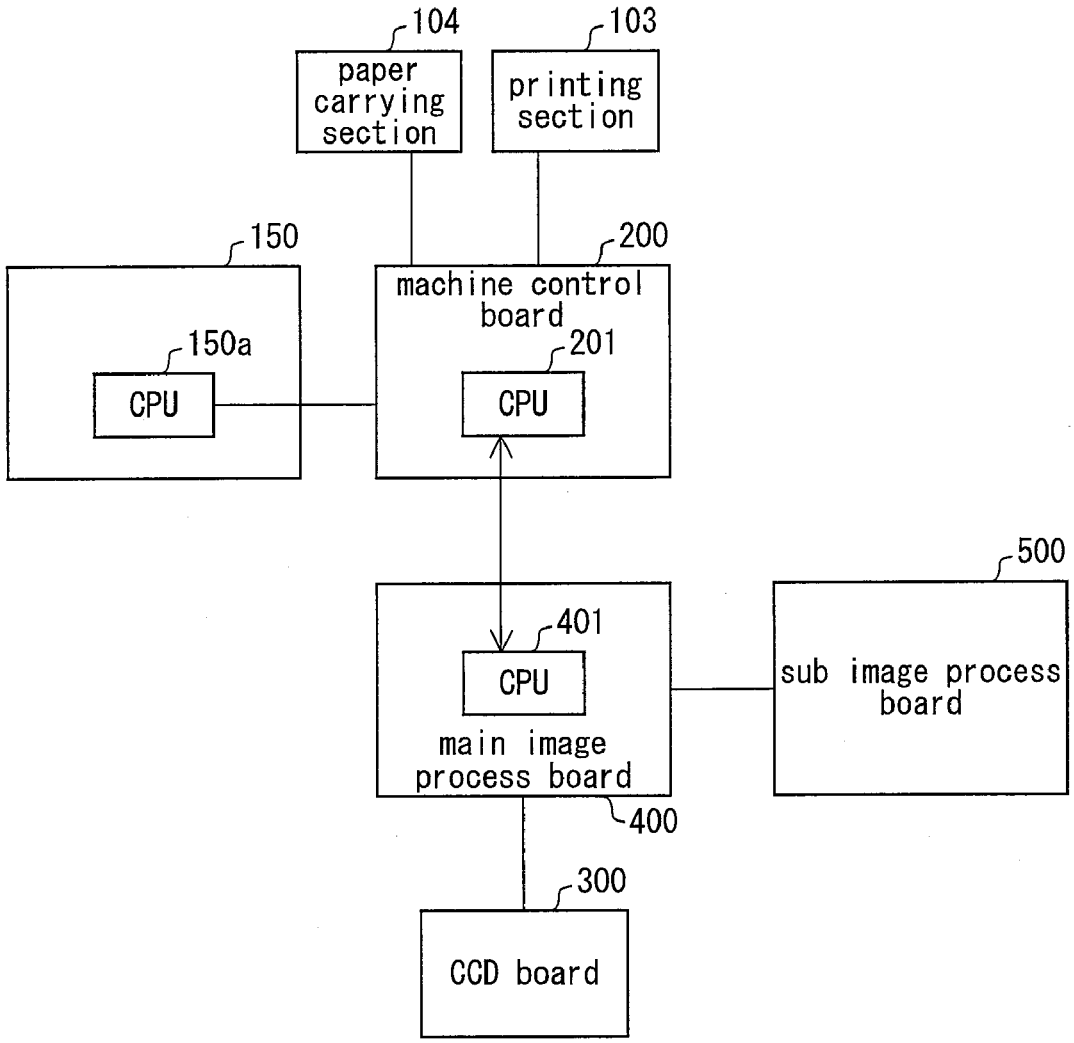
FIG. 5 is a block diagram illustrating a control block of a main part in an image forming system in accordance with Embodiments 1 and 2 of the present invention. The main part is extracted from the control block diagram in FIG. 3 and is illustrated in a simpler form.

FIG. 5 is a drawing illustrating a main part of a control block in the present image forming system (main part is extracted from the control block diagram in FIG. 3 and illustrated in a simpler form). As described above, in the copy mode, image data to be printed is supplied per page from the CCD board 300 to the main image process board 400. In the case where electronic RDH functions in the copy mode, image data to be printed is supplied per page to the main image process board 400 from the sub image process board 500 connected with the main image process board 400 via a connector.

The central processing unit 401 included in the main image process board 400 judges, based on information in the supplied image data per page, whether printing for the image data is two-side printing or one-side printing, and gives necessary instructions to the paper carrying section 104, the printing section 103, the post-process apparatus 150 etc.

In the present embodiment, the central processing unit 401 performs a first change-of-paper-output-velocity prevention control in which, when one-side printing is performed after two-side printing, the central processing unit 401 instructs the post-process apparatus 150 not to change a paper output velocity and instructs the paper carrying section 104 to output paper at a low velocity as in the two-side printing, although it is in the one-side printing.

Further, when two-side printing is performed after one-side printing, the central processing unit 401 instructs the post-process apparatus 150 not to change a paper output velocity and instructs the printing section 103 and the paper carrying section 104 to print image data while inverting front and back surfaces of the image data and to switch back the printed paper and output it at a high velocity.

Figure 1:
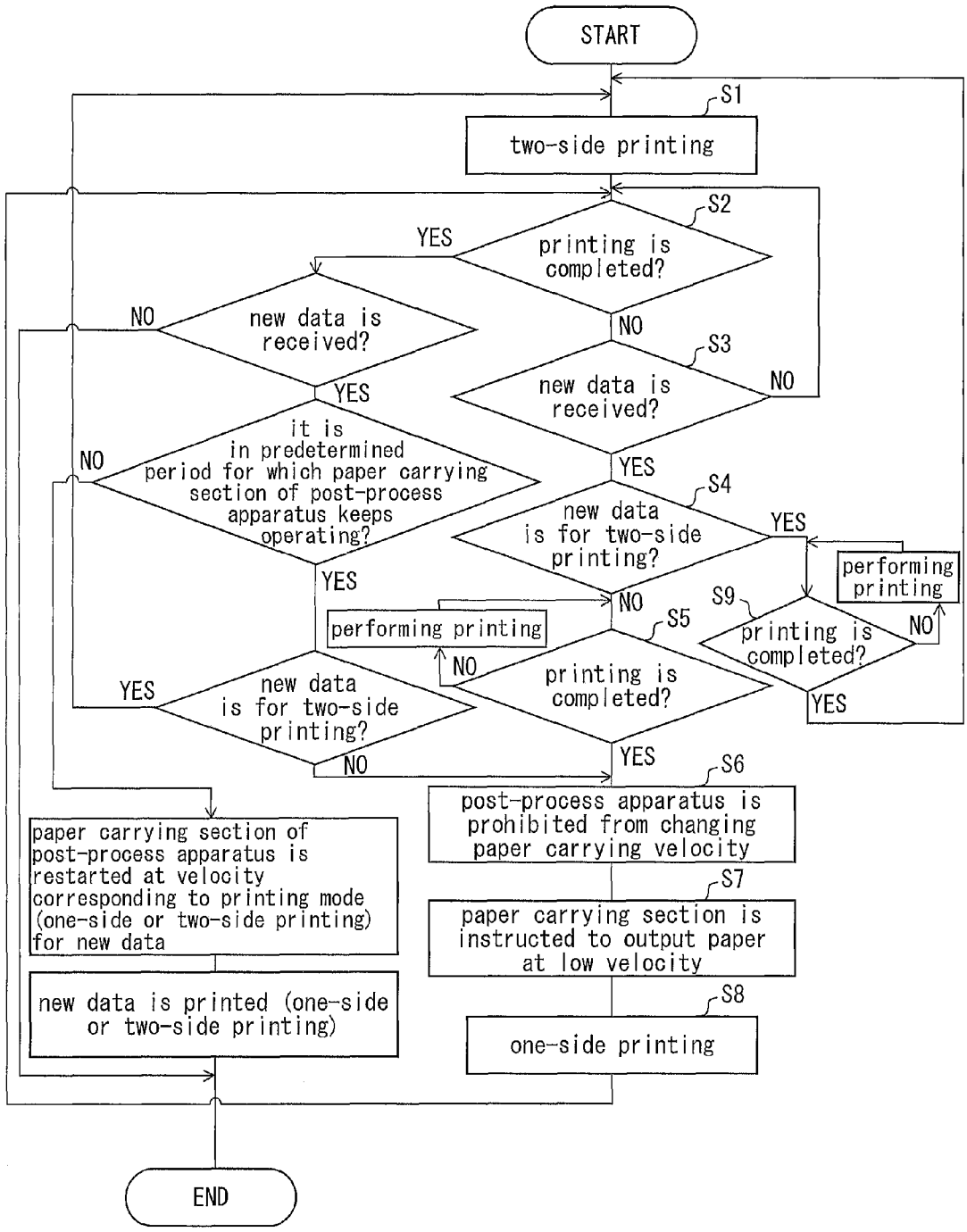
FIG. 1 is a flowchart illustrating a first change-of-paper-output-velocity prevention control performed in an image forming apparatus in an image forming system in accordance with Embodiment 1 of the present invention.
Figure 6:
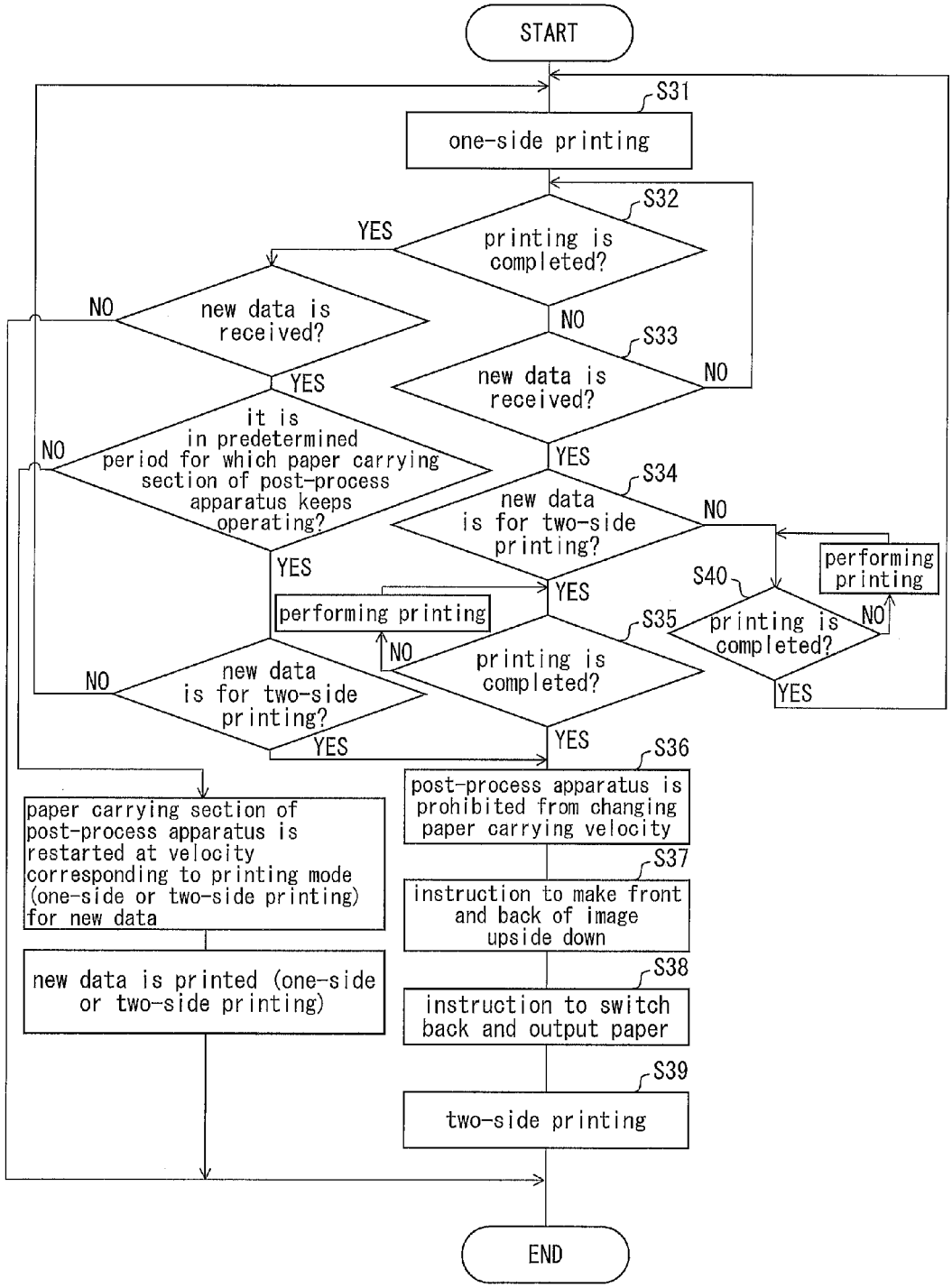
FIG. 6 is a flowchart illustrating a first change-of-paper-output-velocity prevention control performed in an image forming apparatus in an image forming system in accordance with Embodiment 1 of the present invention.

FIGS. 1 and 6 are flow charts each illustrating the first change-of-paper-output-velocity prevention control performed in the image forming apparatus 100. First, with reference to FIG. 1, an explanation is made as to a case where one-side printing is performed after two-side printing.

Two-side printing is performed (S1), and then it is judged whether the two-side printing is completed or not (S2). When the two-side printing is not completed, it is judged whether new image data to be printed is received or not (S3). When it is judged in S3 that new image data is not received, the flow goes back to S2, and S2 and S3 are repeated. Note that when it is judged in S2 that the two-side printing is completed before receiving new image data, the flow ends.

On the other hand, when new image data is received in S3 before it is judged in S2 that the two-side printing is completed, it is judged whether printing for the new image data is two-side printing or not (S4). When the printing for the new image data is two-side printing, the flow goes to S9 and confirms the completion of the previous two-side printing and then goes back to S1, and performs two-side printing with respect to the new image data.

On the other hand, when it is judged in S4 that the printing for the new image data is one-side printing, it is confirmed in S5 that the two-side printing is completed, and then the post-process apparatus 150 is prohibited from changing a paper output velocity (S6). S6 is in fact a step of not sending to the post-process apparatus 150 an instruction to change a paper carrying velocity which should be sent normally.

In S7, the paper carrying section 104 is instructed to output paper at a low velocity in the one-side printing as in the two-side printing, and then the one-side printing is performed (S8).

Next, with reference to FIG. 6, an explanation is made as to a case where two-side printing is performed after one-side printing.

One-side printing is performed (S31) and then it is judged whether the one-side printing is completed or not (S32). When the one-side printing is not completed, it is judged whether new image data to be printed is received or not (S33). When it is judged in S33 that new image data is not received, the flow goes back to S32, and S32 and S33 are repeated. Note that when it is judged in S32 that the one-side printing is completed before receiving new image data, the flow ends.

On the other hand, when new image data is received in S33 before it is judged in S32 that the one-side printing is completed, it is judged whether printing for the new image data is two-side printing or not (S34). When the printing for the new image data is one-side printing, the flow goes to S40 and confirms the completion of the previous one-side printing and then goes back to S31, and performs one-side printing with respect to the new image data.

On the other hand, when it is judged in S34 that the printing for the new image data is two-side printing, it is confirmed in S35 that the one-side printing is completed, and then the post-process apparatus 150 is prohibited from changing a paper output velocity (S36). As with S6, S36 is in fact a step of not sending to the post-process apparatus 150 an instruction to change a paper carrying velocity which should be sent normally.

In S37, the printing section 103 is instructed to print front and back sides of an image in such a manner that the front and back sides are upside down with respect to each other. In S38, the paper carrying section 104 is instructed to switch back and output paper at a high velocity in the two-side printing as in the one-side printing (S39).

As described above, the image forming system of the present embodiment performs the first change-of-paper-output-velocity prevention control in which: when one-side printing is performed right after two-side printing, paper for the one-side printing is output at a low velocity as in the two-side printing and the paper output velocity is not changed in the image forming apparatus 100, and when two-side printing is performed right after one-side printing, paper for the two-side printing is output at a high velocity as in the one-side printing and the paper output velocity is not changed in the image forming apparatus 100.

Consequently, when there is provided the post-process apparatus 150 that takes a comparatively long time to change a paper carrying velocity and that would realize a higher productivity when the paper carrying velocity would not be changed, it is possible to prevent a recording paper carrying velocity of the post-process apparatus 150 from unnecessarily changing according to the change in the paper output velocity of the image forming apparatus 100. Thus, it is possible to prevent drop of productivity of the image forming system and to increase an operating rate of the image forming system.

Here, a consideration is made as to the effect of increasing productivity of the image forming system of the present embodiment. For example, assume that a plurality of image data is serially input to the main image process board 400 in the following order.

1) Two-side printing A (paper output at low velocity)

2) One-side printing B (paper output at high velocity)

3) Two-side printing C (paper output at low velocity)

4) One-side printing D (paper output at high velocity)

If the first change-of-paper-output-velocity prevention control is not performed, the number of changing the paper output velocity is three, i.e. a change from low velocity to high velocity, a change from high velocity to low velocity, and a change from low velocity to high velocity. Even if a time necessary for the post-process apparatus 150 to change the paper carrying velocity is assumed to 20 seconds, the whole process time considerably exceeds 1 minute.

In contrast thereto, in a case where the first change-of-paper-output-velocity prevention control is performed, it is possible to complete printing without changing the paper carrying velocity of the post-process apparatus 150 as presented below.

1) Two-side printing A (paper output at low velocity)
2) One-side printing B (paper output at low velocity)
3) Two-side printing C (paper output at low velocity)
4) One-side printing D (paper output at low velocity)

In the present embodiment, an explanation was made as to a case where paper subjected to one-side printing is output at a low velocity as in two-side printing when image data for one-side printing is transmitted as next printing data while performing the two-side printing (S1-S5 in FIG. 1). Further, the present invention may be arranged so that when image data for one-side printing is received during a predetermined period after performing two-side printing, paper subjected to one-side printing is switched back and output at a low velocity as in two-side printing without changing the paper output velocity.

Similarly, in the present embodiment, an explanation was made as to a case where paper subjected to two-side printing is output at a high velocity as in one-side printing when image data for two-side printing is transmitted as next printing data while performing the one-side printing (S31-S35 in FIG. 6. Further, the present invention may be arranged so that when image data for two-side printing is received during a predetermined period after performing one-side printing, paper subjected to two-side printing is switched back and output at a high velocity as in one-side printing without changing the paper output velocity.

That is, in the first change-of-paper-output-velocity prevention control, whether to judge that changing of the paper output velocity is unnecessary because one-side printing follows two-side printing or two-side printing follows one-side printing depends on whether the paper carrying section of the post-process apparatus 150 continues to operate after the former printing mode ends. If the paper carrying section of the post-process apparatus 150 continues to operate for x seconds after the former printing mode ends, this x seconds should be considered as the aforementioned predetermined period.

Figure 7:
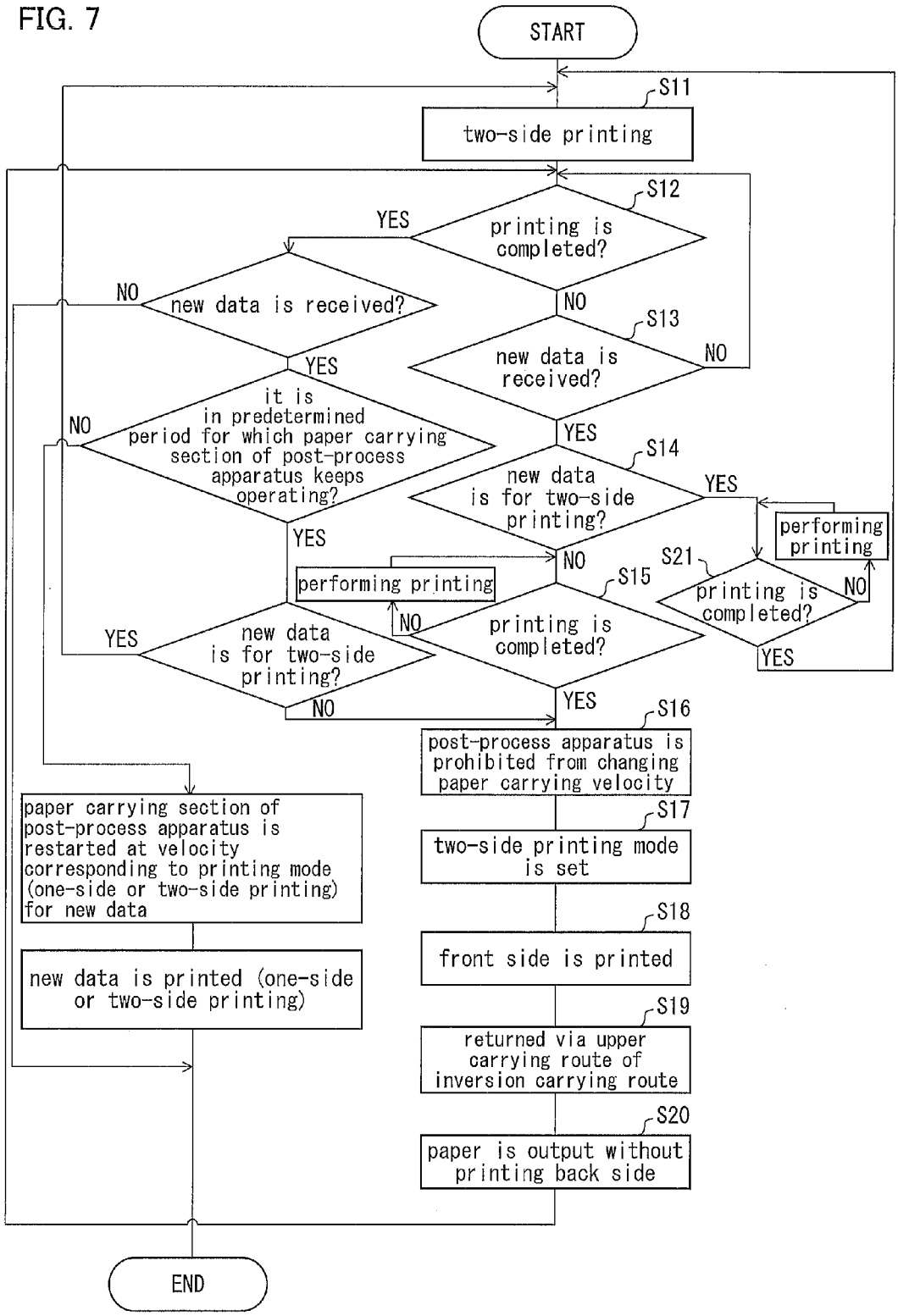
FIG. 7 is a flowchart illustrating a modification example of a first change-of-paper-output-velocity prevention control performed in an image forming apparatus in an image forming system in accordance with Embodiment 1 of the present invention.

Here, with reference to FIG. 7, an explanation is made as to another method for controlling operations of the printing section 103 and the paper carrying section 104 so as not to change the paper output velocity, when image data for one-side printing is transmitted while the central processing unit 401 of the main image process board 400 performs two-side printing.

In the method, when performing one-side printing during a predetermined period after two-side printing, the one-side printing is performed as the two-side printing and paper is output without printing the back surface of the paper. To be more specific, when image data for one-side printing is transmitted as next printing data while performing two-side printing, operations of the printing section 103 and the paper carrying section 104 are controlled so that one-side printing is performed as two-side printing without an image to be formed on the back surface of the paper.

FIG. 5 is a drawing illustrating a main part of a control block in the image forming system of the present invention (the main part is extracted from the control block diagram in FIG. 3 and is illustrated in a simpler form). As described above, in the copy mode, image data to be printed is supplied per page to the main image process board 400 from the CCD board 300, and in a case where the electronic RDH functions in the copy mode or in a case of the printer mode via the extension board 600, image data to be printed is supplied per page to the main image process board 400 from the sub image process board 500 connected with the main image process board 400 via a connector.

The central processing unit 401 of the main image process board 400 judges whether printing for image data supplied per page is two-side printing or one-side printing in accordance with information included in the image data, and gives necessary instructions to the paper carrying section 104, the printing section 103, the post-process apparatus 150, etc.

In this case, when one-side printing is performed right after two-side printing, the central processing unit 401 instructs the post-process apparatus 150 not to change the paper output velocity so that one-side printing is performed as two-side printing without an image to be formed on the back surface of the paper.

FIG. 7 is a flowchart illustrating a second change-of-paper-output-velocity prevention control performed in the image forming apparatus 100.

Two-side printing is performed (S11) and then it is judged whether the two-side printing is completed or not (S12). When the two-side printing is not completed, it is judged whether new image data to be printed is received or not (S13). When it is judged in S13 that new image data is not received, the flow goes back to S12, and S12 and S13 are repeated. Note that when it is judged in S12 that the two-side printing is completed before receiving new image data, the flow ends.

On the other hand, when new image data is received in S13 before it is judged in S12 that the two-side printing is completed, it is judged whether printing for the new image data is two-side printing or not (S14). When the printing for the new image data is two-side printing, the flow goes to S21 and confirms the completion of the previous two-side printing and then goes back to S11, and performs two-side printing with respect to the new image data.

On the other hand, when it is judged in S14 that the printing for the new image data is one-side printing, it is confirmed in S15 that the two-side printing is completed, and then the post-process apparatus 150 is prohibited from changing a paper output velocity (S16). As with S6, S16 is in fact a step of not sending to the post-process apparatus 150 an instruction to change a paper carrying velocity which should be sent normally.

In S17, a two-side printing mode is set to the printing section 103 and the paper carrying section 104, the new image data for one-side printing is printed on a surface (first surface) of paper (S18), the paper is returned to the printing section 103 via the upper carrying route 44-2 of the inversion carrying route 44 (S19), and the paper is output without the back surface (second surface) of the paper being printed. Here, the printing section 103 operates normally by writing whiteout image data on the photoreceptor drum 21. Only the transfer unit 25 does not operate normally, and an electric field whose polarity is opposite to that of a normally applied electric filed is applied on the transfer unit 25 in order that unnecessary toner does not attach to the paper.

Thus, the paper output velocity of the image forming apparatus 100 can be kept to be that of two-side printing, by performing one-side printing as two-side printing without an image to be formed on the back surface of the paper.

In this method, too, an explanation was made as to a case where paper subjected to one-side printing is output at a low velocity as in two-side printing without changing the paper output velocity, when image data for one-side printing is transmitted as next printing data while performing two-side printing (S11 to S15 in FIG. 7. Further, in a case where the paper carrying section of the post-process apparatus 150 continues to operate for x seconds after the former printing mode ends, this method also may be arranged so that when receiving image data for one-side printing within x seconds after the two-side printing ends, the paper subjected to one-side printing is output at a low velocity as in the two-side printing without changing the paper output velocity.

Embodiment 2

Figure 8:
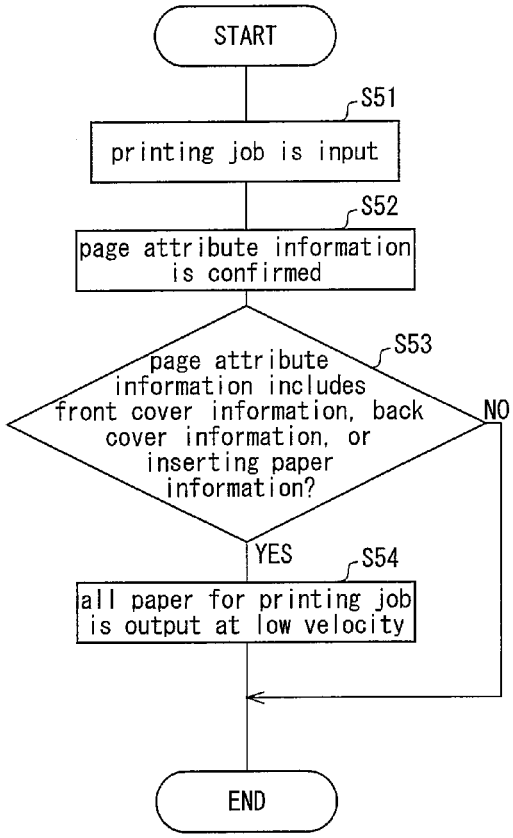
FIG. 8 is a flowchart illustrating a second change-of-paper-output-velocity prevention control performed in an image forming apparatus in an image forming system in accordance with Embodiment 2 of the present invention.

The following explains another embodiment of the present invention with reference to FIG. 8. For convenience of explanation, members having the same functions as those in Embodiment 1 are given the same reference numerals and explanations thereof will be omitted here.

The image forming system of the present embodiment has substantially the same arrangement as that of the image forming system of Embodiment 1 except for an arrangement for reducing the number of changing a paper output velocity of the image forming apparatus 100 according to a change in a printing mode.

In the image forming system of the present embodiment, in order to reduce the number of changing a paper output velocity in the image forming apparatus 100 according to a change in a printing mode, paper carrying operation of the paper carrying section 104 is controlled so that all paper is output at a low velocity when performing a printing job including image data to which page attribute information such as front cover information, back cover information, and inserting paper information is attached.

Specifically, when a page attribute information detection section (page attribute information detection means) detects page attribute information such as front cover information, back cover information, and inserting paper information that is attached to image data per page included in a printing job, a second change-of-paper-output-velocity prevention section (second change-of-paper-output-velocity prevention means) controls operation of the paper carrying section 104 or operations of the paper carrying section 104 and the printing section 103 so that a paper output velocity for one-side printing in the printing job is the same as that for two-side printing.

The page attribute information detection section and the second change-of-paper-output-velocity prevention section are realized by the central processing unit 401 of the main image process board 400.

FIG. 5 is a drawing illustrating a main part of a control block of the image forming system of the present embodiment (the main part is extracted from the control block diagram in FIG. 3 and is illustrated in a simpler form). As described above, in the copy mode, image data to be printed is supplied per page to the main image process board 400 from the CCD board 300, and in a case where the electronic RDH functions in the copy mode or in a case of the printer mode via the extension board 600, image data to be printed is supplied per page to the main image process board 400 from the sub image process board 500 connected with the main image process board 400 via a connector.

The central processing unit 401 of the main image process board 400 judges whether printing for image data supplied per page is two-side printing or one-side printing in accordance with information included in the image data, and gives necessary instructions to the paper carrying section 104, the printing section 103, the post-process apparatus 150, etc.

Not only image data per page but also attribute information indicative of an attribute of the page, i.e. any one of front cover information used for a front cover in bookbinding, back cover information used for a back cover in bookbinding, text information for printing text data, and inserting paper information for inserting paper between texts, are transferred from the sub image process board 500 to the main image process board 400.

In a case of a front cover, only a surface of paper is subjected to printing, which is regarded as one-side printing. On the other hand, in a case of a back cover, a back surface of the paper is subjected to printing, and in a case of an inserting paper, a front surface, a back surface, or both surfaces of the paper are subjected to printing. Therefore, in the present embodiment, even in a case of text data for one-side printing, the sub image process board 500 estimates that back cover information exists when front cover information exists, and the sub image process board 500 estimates that two-side printing is performed when inserting paper information exists. Thus, the sub image process board 500 informs the main image process board 400 of information such as front cover information, back cover information, and inserting paper information that is attached to image data. Thus, the main image process board 400 selects to output all of paper for the printing job at a low velocity.

In order that all of the paper for the printing job are output at a low velocity, it is necessary to output the paper for one-side printing at a low velocity. Specific examples of the method include: a method for controlling the paper carrying section 104 so that a paper output velocity in one-side printing is the same as a paper output velocity in two-side printing, which is employed in the image forming system of Embodiment 1; and a method for performing one-side printing as two-side printing without image data to be formed on a back surface of the paper and outputting the paper.

FIG. 8 is a flowchart illustrating the second change-of-paper-output-velocity prevention control performed in the image forming apparatus 100.

Here, when a new printing job is input (S51), page attribute information in image data per page included in the printing job is confirmed (S52). Then, it is judged whether the page attribute information includes front cover information, back cover information, or inserting paper information (S53). When the page attribute information includes such information, all paper on which texts included in the printing job are printed is output at a low velocity, regardless of whether in two-side printing mode or in one-side printing mode (S54). On the other hand, when it is judged in S53 that the page attribute information does not include front cover information, back cover information, or inserting paper information, the flow ends.

As described above, in the image forming system of the present embodiment, there is performed the second change-of-paper-output-velocity prevention control in which when a printing job includes image data to which page attribute information such as front cover information, back cover information, and inserting paper information is attached, even when texts in the image data is for one-side printing, paper is output at a low velocity as in two side-printing. This excludes an inconvenience that a paper output velocity of the image forming apparatus 100 changes according to different printing modes in one printing job and the post-process apparatus 150 stops for a long time. Consequently, it is possible to greatly increase productivity in bookbinding mode in the image forming system.

In this case, text data subjected to one-side printing is output at a low velocity, and therefore the velocity is slower than a normal printing velocity for one-side printing. However, productivity can be sufficiently increased, considering that it takes 20 to 30 seconds for the post-process apparatus 150 to change the paper carrying velocity.

The second change-of-paper-output-velocity prevention control can be employed in combination with any one of the first change-of-paper-output-velocity prevention controls described in Embodiment 1.

Embodiment 3

Figure 9:
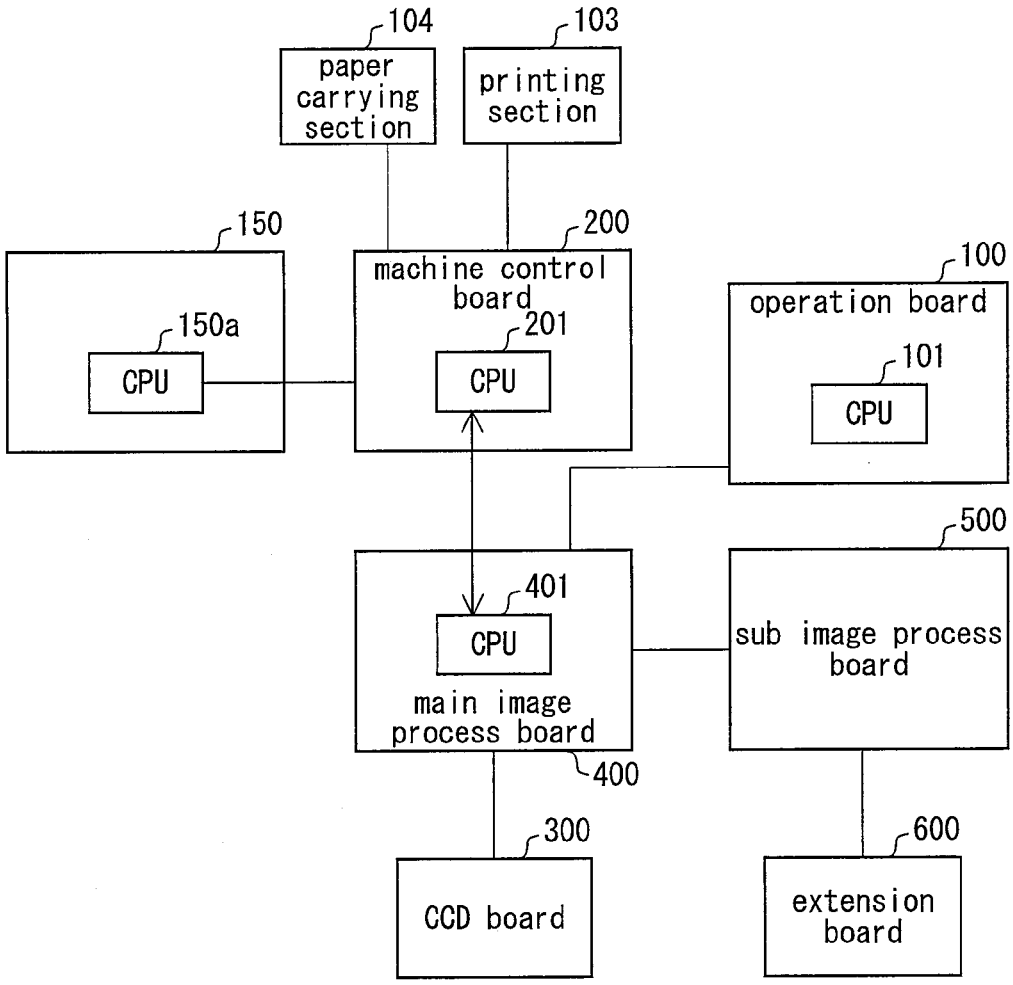
FIG. 9 is a block diagram illustrating a control block of a main part in an image forming system in accordance with Embodiment 3 of the present invention. The main part is extracted from the control block diagram in FIG. 3 and is illustrated in a simpler form.
Figure 10:
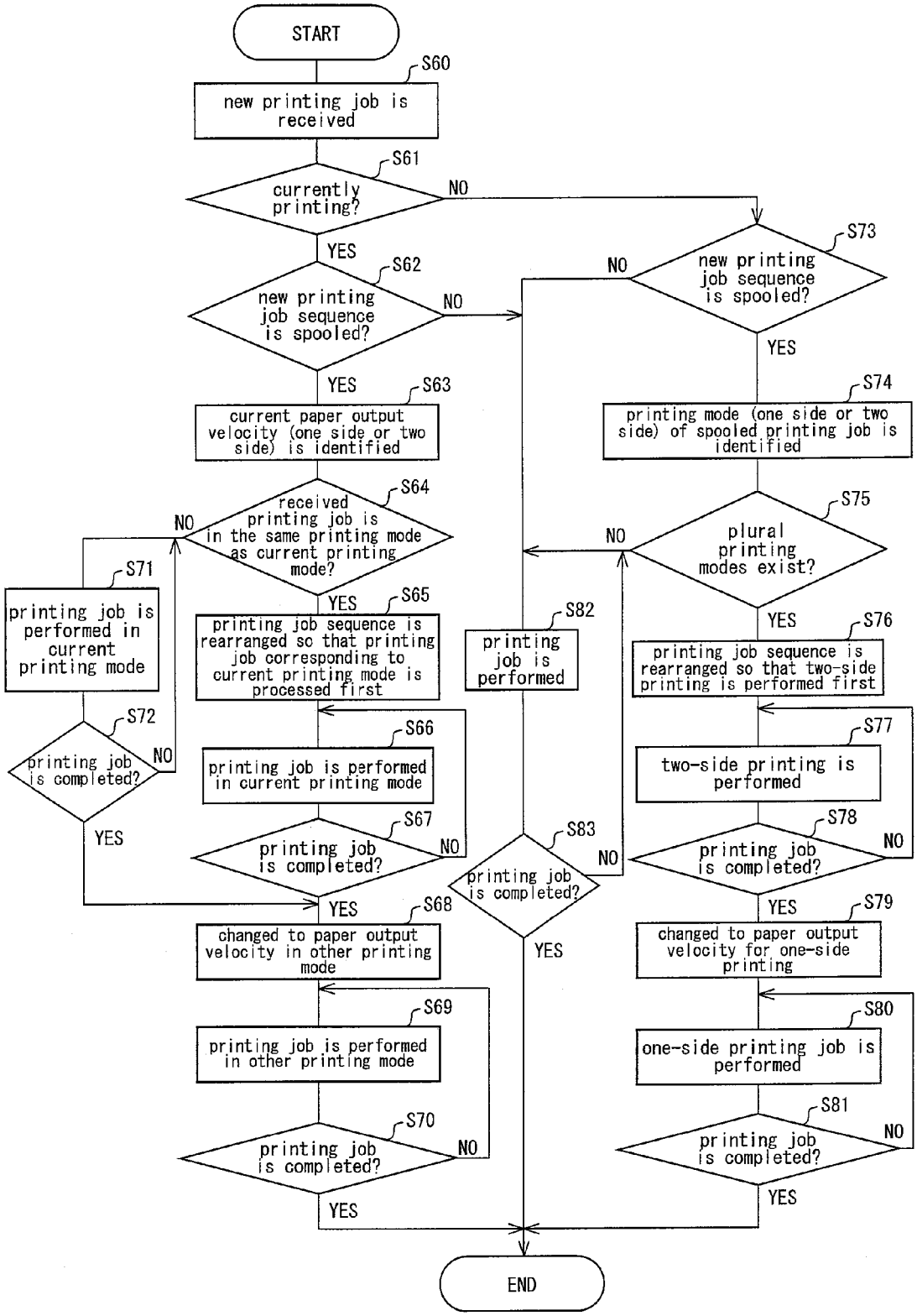
FIG. 10 is a flowchart illustrating a third change-of-paper-output-velocity prevention control performed in an image forming apparatus in an image forming system in accordance with Embodiment 3 of the present invention.

The following explains further another embodiment of the present invention with reference to FIGS. 9 and 10. For convenience of explanation, members having the same functions are given the same reference numerals and explanations thereof are omitted here.

The image forming system of the present embodiment has substantially the same arrangement as the arrangements of the image forming systems of Embodiments 1 and 2 except for an arrangement for reducing the number of changing the paper output velocity of the image forming apparatus 100 according to a change in printing modes.

In the image forming system of the present embodiment, the order of processing spooled printing jobs is changed so as to reduce the number of changing the paper output velocity of the image forming apparatus 100 according to a change in printing modes.

Specifically, in the image forming system of the present embodiment, when a printing job monitoring section (printing job monitoring means) estimates that a spooled printing job sequence includes a printing job for one-side printing and a printing job for two-side printing and that the number of changing the paper output velocity is two or more, a third change-of-paper-output-velocity prevention section (third change-of-paper-output-velocity prevention means) changes the order of processing printing jobs so that one of the one-side printing and the two-side printing is performed first.

Thus, when a plurality of printing jobs are spooled, the printing mode of each spooled printing job is identified, and the order of processing the spooled printing jobs is changed so that the spooled printing jobs are processed not in the order of reception of the printing jobs (in the order of inputting the printing jobs) but in the order which makes the number of changing the paper output velocity to be smaller, printing jobs corresponding to one of the one-side printing and the two-side printing are processed first, and then the paper output velocity is changed so as to process printing jobs corresponding to the other of the one-side printing and the two-side printing.

When a plurality of printing jobs are received and they are processed in the order of reception, there is a possibility that the paper output velocity of the image forming apparatus 100 is frequently changed. However, the above arrangement reduces the number of changing the paper output velocity as little as possible, thereby increasing productivity of the image forming system.

Further, a stopping detection section (stopping detection means) detects stopping of a paper carrying section of the post-process apparatus 150. When the paper carrying section of the post-process apparatus 150 stops, the third change-of-paper-output-velocity prevention section processes printing jobs corresponding to the two-side printing in preference to printing jobs corresponding to the one-side printing.

The number of received printing jobs corresponding to one-side printing is larger than the number of received printing jobs corresponding to two-side printing. Therefore, by processing printing jobs corresponding to two-side printing before printing jobs corresponding to one-side printing, it is possible to process new one-side printing jobs that are generated and spooled thereafter, without requiring a change in a paper output velocity. Consequently, it is possible to increase productivity and an operating rate of the image forming system.

The printing job monitoring section, the stopping detection section, and the third change-of-paper-output-velocity prevention section are realized by the central processing unit 401 of the main image process board 400.

FIG. 9 is a drawing illustrating a main part of a control block in the present image forming system (main part is extracted from the control block diagram in FIG. 3 and illustrated in a simpler form). As described above, in the copy mode, image data to be printed is supplied per page to the main image process board 400 from the CCD board 300. In a case where electronic RDH functions in the copy mode or in a case of the printer mode using the extension board 600, image data to be printed is supplied per page to the main image process board 400 from the sub image process board 500 connected with the main image process board 400 via a connector.

The central processing unit 401 included in the main image process board 400 judges, based on information in the image data per page, whether printing for the image data is two-side printing or one-side printing, and gives necessary instructions to the paper carrying section 104, the printing section 103, the post-process apparatus 150 etc.

Further, the central processing unit 401 receives a printing job in the copy mode via the operation panel board 700, and receives a printing job in the printer mode or the facsimile mode via the extension board 600 and the sub image process board 500.

In a conventional device, received printing jobs are processed in the order of reception. In contrast thereto, the central processing unit 401 of the present embodiment serves as the third change-of-paper-output-velocity prevention means and performs a third change-of-paper-output-velocity prevention control so that the spooled printing jobs are rearranged and one of a printing job in the one-side printing mode and a printing job in the two-side printing mode is processed first and then the paper output velocity is changed and the other of the printing job in the one-side printing mode and the printing job in the two-side printing mode is processed.

In a case where a new printing job is spooled while the central processing unit 401 processes a printing job, when the newly received printing job is in the same printing mode as that of the currently processed printing job, paper output velocities for the newly received printing job and for the currently processed printing job are the same as each other. Therefore, the central processing unit 401 rearranges the printing jobs so that the newly received printing job is processed before the printing job in the other printing mode.

In a case where a new printing job is spooled while the central processing unit 401 does not process a printing job, the central processing unit 401 processes a printing job in the two-side printing mode before a printing job in the one-side printing mode. This is because most of the received printing jobs are in the one-side printing mode. By processing a printing job in the one-side printing mode later, the image forming apparatus 100 stands by in a state for outputting paper at a high velocity corresponding to the one-side printing, which allows the image forming apparatus 100 to process a next printing job in the one-side printing mode without delay.

FIG. 10 is a flow chart illustrating the third change-of-paper-output-velocity prevention control performed in the image forming apparatus 100.

While printing (S61), when a new printing job sequence is spooled (S62), a current printing mode in the image forming apparatus 100 is identified and a paper output velocity is grasped (S63). When a new printing job is received while at least one printing job other than a currently processed job has been received, it is judged that a new printing job sequence is spooled.

Further, it is judged whether the received printing job is in the same printing mode as a current printing mode of the image forming apparatus 100 (S64). Here, when it is judged that the received printing job is in the same printing mode as the current printing mode, a printing job sequence is arranged so that a printing job corresponding to a current printing mode (i.e. paper output velocity) in the image forming apparatus 100 is processed first (S65), and the printing job is carried out in the current printing mode (S66). Thus, the newly received printing job is carried out before unprocessed printing jobs in the other printing mode. After confirming in S67 that printing is completed, the paper output velocity of the image forming apparatus 100 is changed to a paper output velocity in the other printing mode (S68), and the printing jobs in the other printing mode are carried out (S69). Then, it is confirmed in S70 that printing is completed, and the control ends.

On the other hand, when it is judged in S64 that the printing job in the same printing mode are not received, printing jobs are carried out in the current printing mode of the image forming apparatus 100 without rearranging the printing job sequence (S71), it is confirmed in S72 that printing is completed, and then the flow goes to S68.

When a new printing job sequence is not spooled in S62, i.e. when it is judged in S62 that other unprocessed printing jobs do not exist, the control goes to S82. The newly received printing job is carried out in S82, and completion of printing is confirmed in S83, and the control ends.

On the other hand, while the image forming apparatus 100 stands by without printing (S61), when a new printing job sequence is spooled (S73), a printing mode of a plurality of spooled printing jobs is identified (S74), and it is judged whether a plurality of printing modes exist or not (i.e. whether the paper output velocity for each printing job is identical with each other or not) (S75). The route from S60 to S73 via S61 indicates a case where the image forming apparatus 100 temporarily stops because paper is out, transfer of paper is jammed, etc.

When it is judged in S75 that a plurality of printing modes does not exist, the control goes to S82. In S82, the newly received printing jobs are carried out, and in S83, completion of printing is confirmed, and then the control ends. Unlike a case of transition from S62 to S82, in a case of transition from S75 to S82, a plurality of printing jobs may be processed in S82.

On the other hand, when it is judged in S75 that a plurality of printing modes exist, the printing job sequence is arranged so that a printing job corresponding to the two-side printing mode is processed first (S76), the printing job corresponding to the two-side printing is processed first (S77), and completion of printing is confirmed (S78). Then, the paper output velocity of the image forming apparatus 100 is changed to a paper output velocity for one-side printing that is the other printing mode (S79), and printing jobs in the one-side printing are carried out (S80). Completion of printing is confirmed in S81 and the control ends.

As described above, in the image forming system of the present embodiment, there is performed the third change-of-paper-output-velocity prevention control in which when a plurality of printing jobs are spooled, the spooled printing job sequence is rearranged and a printing job in one of one-side printing mode and two-side printing mode is carried out first, and then the paper output velocity is changed and a printing job in the other of the one-side printing mode and the two-side printing mode is carried out. This prevents frequent switching of the paper output velocity of the image forming apparatus 100 due to processing printing jobs in the order of reception, thereby increasing productivity of the image forming system.

For example, assume that a printing job sequence received by the main image process board 400 and spooled in the order of reception is as follows.

1) Two-side printing job A (paper output at low velocity)
2) One-side printing job B (paper output at high velocity)
3) Two-side printing job C (paper output at low velocity)
4) One-side printing job D (paper output at high velocity)

In a case where the third change-of-paper-output-velocity prevention control is not carried out, the printing jobs A-D are carried out in this order. Consequently, the number of changing the paper output velocity is three, i.e. changes from a low velocity to a high velocity, from a high velocity to a low velocity, and from a low velocity to a high velocity.

On the other hand, in a case where the third change-of-paper-output-velocity prevention control is carried out, while a printing job in two-side printing mode is being carried out, the printing jobs A-D are rearranged in S65 to be as follows.

1) Two-side printing job A (paper output at low velocity)
2) Two-side printing job C (paper output at low velocity)
3) One-side printing job B (paper output at high velocity)
4) One-side printing job D (paper output at high velocity)

While a printing job is not being carried out, the printing jobs A-D are rearranged in S76 to be as described above. On the other hand, while a printing job in one-side printing mode is being carried out, the printing jobs A-D are rearranged as follows.

1) One-side printing job B (paper output at high velocity)
2) One-side printing job D (paper output at high velocity)
3) Two-side printing job A (paper output at low velocity)
4) Two-side printing job C (paper output at low velocity)

By rearranging the printing job sequence in this way, the number of changing the paper output velocity is only one, i.e. a change from a low velocity to a high velocity or vice versa.

The third change-of-paper-output-velocity prevention control may be employed in combination with the first and second change-of-paper-output-velocity prevention controls described in Embodiments 1 and 2.

In Embodiments 1-3, the first, second, and third change-of-paper-output-velocity prevention control sections (means), the printing process generation detection section (means), the page attribute information detection section (means), the printing job monitoring section (means), and the stopping detection section (means) may be realized by software with use of CPU as described in the embodiments of the present invention, or may be realized by hardware logic.

Namely, the image forming apparatus 100 includes: a CPU (central processing unit) for executing a program for realizing functions of each block; a ROM (read only memory) that stores the program; a RAM (random access memory) that develops the program; a storage device (storage medium) such as a memory for storing the program and various data; and the like. The object of the present invention can be realized in such a manner that the image forming apparatus 100 is provided with a computer-readable storage medium for storing program codes (such as executable program, intermediate code program, and source program) of programs of the image forming apparatus 100 which programs serve as software for realizing the functions, and a computer (alternatively, CPU or MPU) reads out and executes the program codes stored in the storage medium.

The storage medium is, for example, tapes such as a magnetic tape and a cassette tape, or discs such as magnetic discs (e.g. a floppy Disc® and a hard disc), and optical discs (e.g.

CD-ROM, MO, MD, DVD, and CD-R). Further, the storage medium may be cards such as an IC card (including a memory card) and an optical card, or semiconductor memories such as mask ROM, EPROM, EEPROM, and flash ROM.

Further, the image forming apparatus 100 may be arranged so as to be connectable to a communication network so that the program code is supplied to the image forming apparatus 100 through the communication network. The communication network is not particularly limited. Examples of the communication network include the Internet, intranet, extranet, LAN, ISDN, VAN, CATV communication network, virtual private network, telephone network, mobile communication network, and satellite communication network. Further, a transmission medium that constitutes the communication network is not particularly limited. Examples of the transmission medium include (i) wired lines such as IEEE 1394, USB, power-line carrier, cable TV lines, telephone lines, and ADSL lines and (ii) wireless connections such as IrDA and remote control using infrared ray, Bluetooth®, 802.11, HDR, mobile phone network, satellite connections, and terrestrial digital network. Note that the present invention can be also realized by the program codes in the form of a computer data signal embedded in a carrier wave, which is the program that is electrically transmitted.

The present invention is not limited to the description of the embodiments above, but may be altered by a skilled person within the scope of the claims. An embodiment based on a proper combination of technical means disclosed in different embodiments is encompassed in the technical scope of the present invention.

As described above, the image forming apparatus in accordance with a first aspect of the present invention is an image forming apparatus, provided with a post-process apparatus for performing a post-process on recording paper output from the image forming apparatus, the image forming apparatus and the post-process apparatus constituting an image forming system, the image forming apparatus including: an image forming section capable of two-side printing for forming images on both sides of the recording paper and one-side printing for forming an image on one side of the recording paper; a recording paper carrying section for, in the two-side printing, outputting the recording paper without switching back the recording paper, and for, in the one side-printing, switching back the recording paper and thereafter outputting the recording paper at a velocity higher than that for the two-side printing; printing process generation detection means for detecting generation of one of the one-side printing and the two-side printing that is performed within a predetermined period after the other of the one-side printing and the two-side printing; and first change-of-paper-output-velocity prevention means for controlling the recording paper carrying section or both of the recording paper carrying section and the image forming section so that the paper output velocity does not change, when the printing process generation detection means detects generation of said one of the one-side printing and the two-side printing.

With the arrangement, when the post-process apparatus requires a relatively long time to change a carrying velocity of recording paper and would have higher productivity without changing the carrying velocity, it is possible to prevent the post-process apparatus from unnecessarily changing the recording paper carrying velocity in accordance with a change in the paper output velocity of the image forming apparatus, thereby preventing drop in productivity of the image forming system and increasing an operating ratio of the image forming system.

For example, in a case of performing one-side printing after two-side printing, the first change-of-paper-output-velocity prevention means can be realized by an arrangement for controlling the recording paper carrying section so that recording paper for the one-side printing is switched back and then output at a velocity identical with that of the two-side printing.

Alternatively, in a case of performing one-side printing after two-side printing, the first change-of-paper-output-velocity prevention means can be realized by an arrangement for controlling the image forming section and the recording paper carrying section so that the one-side printing is performed as the two-side printing without an image to be formed on a back side of recording paper.

With the arrangement, the one-side printing is performed as the two-side printing, and therefore a paper output velocity of the one-side printing is the same as that of the two-side printing. Consequently, there is no change in the paper output velocity of the image forming apparatus.

Further, in a case of performing two-side printing after one-side printing, the first change-of-paper-output-velocity prevention means can be realized by an arrangement for controlling the image forming section and the recording paper carrying section so that images on front and back sides of recording paper are formed upside down with respect to each other in the two-side printing and that the recording paper subjected to the two-side printing is switched back and then output at a velocity identical with that for the one-side printing.

With the arrangement, paper for the two-side printing is output via the same route as that for paper for the one-side printing, and therefore the paper for the two-side printing is output at the same velocity as that of the paper for the one-side printing. Consequently, the paper output velocity is not changed.

An image forming apparatus in accordance with a second aspect of the present invention is an image forming apparatus, provided with a post-process apparatus for performing a post-process on recording paper output from the image forming apparatus, the image forming apparatus and the post-process apparatus constituting an image forming system, the image forming apparatus including: an image forming section capable of two-side printing for forming images on both sides of the recording paper and one-side printing for forming an image on one side of the recording paper; a recording paper carrying section for, in the two-side printing, outputting the recording paper without switching back the recording paper, and for, in the one side-printing, switching back the recording paper and thereafter outputting the recording paper at a velocity higher than that for the two-side printing; page attribute information detection means for detecting page attribute information that is attached to image data per page included in a printing job, the page attribute information being one of front cover information, back cover information, and inserting paper information; and second change-of-paper-output-velocity prevention means for controlling the recording paper carrying section or both of the recording paper carrying section and the image forming section so that a paper output velocity of recording paper for the one-side printing in the printing job is identical with a paper output velocity of recording paper for the two-side printing, when the page attribute information detection means detects page attribute information.

The back cover information indicates that the image data is indicative of a back cover. The back cover is made by printing the back side of the recording paper and therefore processed in two-side printing. Therefore, the presence of the back cover information indicates that two-side printing will be required in order to complete the printing job.

The inserting paper information indicates that the image data is indicative of inserting paper. The inserting paper is made by printing the front side, the back side, or both sides of the recording paper and therefore may be processed in two-side printing. Therefore, the presence of the inserting paper information indicates that two-side printing may be required in order to complete the printing job.

The front cover information indicates that the image data is indicative of a front cover. The front cover is made by printing the front side of the recording paper and therefore processed in one-side printing. However, presence of the front cover indicates presence of the back cover that is processed in two-side printing.

With the arrangement, the page attribute information detection means detects the page attribute information such as front cover information, back cover information, and inserting paper information that is attached to image data per page included in a printing job and that indicates whether such two-side printing will be carried out or not.

When the page attribute information detection means detects the page attribute information, the second change-of-paper-output-velocity prevention means controls the recording paper carrying section or both of the recording paper carrying section and the image forming section so that a paper output velocity for image data in one-side printing included in the printing job is identical with a paper output velocity for image data in two-side printing included in the printing job.

Therefore, when the post-process apparatus requires a relatively long time to change a carrying velocity of recording paper and would have higher productivity without changing the carrying velocity, it is possible to prevent the post-process apparatus from unnecessarily changing the recording paper carrying velocity in accordance with a change in the paper output velocity of the image forming apparatus, thereby preventing drop in productivity of the image forming apparatus and increasing operating ratio of the image forming apparatus.

For example, the second change-of-paper-output-velocity prevention means can be realized by an arrangement for controlling the recording paper carrying section so that recording paper for the one-side printing is switched back and output at a velocity identical with that of the two-side printing.

Alternatively, the second change-of-paper-output-velocity prevention means can be realized by an arrangement for controlling the recording paper carrying section and the image forming section so that one-side printing is performed as two-side printing without an image to be formed on a back side of recording paper.

With the arrangement, one-side printing is performed as two-side printing, and therefore a paper output velocity of the one-side printing is the same as that of the two-side printing. Consequently, there is no change in the paper output velocity of the image forming apparatus.

As described above, an image forming apparatus in accordance with a third aspect of the present invention is an image forming apparatus, provided with a post-process apparatus for performing a post-process on recording paper output from the image forming apparatus, the image forming apparatus and the post-process apparatus constituting an image forming system, the image forming apparatus including: an image forming section capable of two-side printing for forming images on both sides of the recording paper and one-side printing for forming an image on one side of the recording paper; a recording paper carrying section for, in the two-side printing, outputting the recording paper without switching back the recording paper, and for, in the one side-printing, switching back the recording paper and thereafter outputting the recording paper at a velocity higher than that for the two-side printing; printing job monitoring means for monitoring whether a spooled printing job sequence includes a printing job in one-side printing and a printing job in two-side printing and for predicting whether the number of changing a paper output velocity will be two or more; and third change-of-paper-output-velocity prevention means for changing an order of processing printing jobs so that one of the printing job in the one-side printing and the printing job in the two-side printing is given priority, when the printing job monitoring means predicts that the number of changing a paper output velocity will be two or more.

With the arrangement, the printing job monitoring means predicts whether the spooled printing job sequence includes a printing job in the one-side printing and a printing job in the two-side printing and the number of changing a paper output velocity will be two or more.

For example, when two-side printing job A, one-side printing job B, and two-side printing job C are spooled in this order, the printing job monitoring means predicts that the number of changing a paper output velocity will be two or more. The first two-side printing job A may be a job that is under processing.

When the printing job monitoring means predicts that the number of changing a paper output velocity will be two or more, the third change-of-paper-output-velocity prevention means changes the order of processing the printing jobs so that one of the one-side printing and the two-side printing is performed first.

That is, the order of the two-side printing job A, the one-side printing job B, and the two-side printing job C is changed to the order of the two-side printing job A, the two-side printing job C, and the one-side printing job B, or the order of the one-side printing job B, the two-side printing job A, and the two-side printing job C. When the first two-side printing job A is under processing, the order is changed to the order of the two-side printing job A, the two-side printing job C, and the one-side printing job B.

Consequently, the number of changing a paper output velocity changes from two to one, thereby reducing the number of changing a paper output velocity.

Therefore, when the post-process apparatus requires a relatively long time to change a carrying velocity of recording paper and would have higher productivity without changing the carrying velocity, it is possible to prevent the post-process apparatus from unnecessarily changing the recording paper carrying velocity in accordance with a change in the paper output velocity of the image forming apparatus, thereby preventing drop in productivity of the image forming apparatus and increasing an operating ratio of the image forming apparatus.

The image forming apparatus of the present invention may be arranged so as to further include stopping detection means for detecting that a recording paper carrying section of the post-process apparatus stops, the third change-of-paper-output-velocity prevention means causing the printing job in the two-side printing to be performed before the printing job in the one-side printing.

The number of received printing jobs corresponding to one-side printing is larger than the number of received printing jobs corresponding to two-side printing. Therefore, by causing printing jobs corresponding to two-side printing to be performed before printing jobs corresponding to one-side printing, it is possible to process new one-side printing jobs that are generated and spooled thereafter, without requiring a change in a paper output velocity. Consequently, it is possible to increase productivity and operating rate of the image forming system.

Further, the present invention encompasses an image forming system including: any one of the image forming apparatuses in accordance with the first to third aspects of the present invention; and a post-process apparatus for performing a post-process on recording paper output from the image forming apparatus and for temporarily stopping a carrying roller when changing a recording paper carrying velocity in the post-process apparatus in accordance with a change in the paper output velocity of the image forming apparatus.

Each means of the image forming apparatus, i.e. the first to third change-of-paper-output-velocity prevention means, the printing process generation detection means, the page attribute information detection means, the printing job monitoring means, and the stopping detection means may be realized by hardware or may be realized by a computer executing a program. Specifically, in a storage medium in accordance with the present invention, a program for causing a computer to function as each means of the image forming apparatus is stored.

When a computer executes the program, the computer functions as the image forming apparatus. Therefore, as with the aforementioned image forming apparatuses, when this image forming apparatus is provided with a post-process apparatus to form an image forming system, it is possible to prevent unnecessary changes in the recording paper carrying velocity of the post-process apparatus and to prevent drop in productivity of the image forming system, thereby increasing an operating ratio of the image forming system.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, provided with a post-process apparatus for performing a post-process on recording paper output from the image forming apparatus, the image forming apparatus and the post-process apparatus constituting an image forming system, the image forming apparatus comprising:

an image forming section capable of two-side printing for forming images on both sides of the recording paper and one-side printing for forming an image on one side of the recording paper; and a recording paper carrying section comprising an inversion carrying route and an output roller, the recording paper carrying section for, in the two-side printing, outputting the recording paper from the output roller to the post-process apparatus without switching back the recording paper by the inversion carrying route, and for, in the one side-printing, switching back the recording paper by the inversion carrying route and thereafter outputting the recording paper from the output roller to the post-process apparatus, the recording paper carrying section controlled by a controller such that a velocity of the recording paper output from the output roller for the one-side printing is higher than that for the two-side printing, the post-process apparatus comprising a carrying roller and a central processing unit, the post-process apparatus configured to temporarily stop the carrying roller of the post-process apparatus when changing a recording paper carrying velocity in the post-process apparatus in accordance with an instruction received at the central processing unit from the controller of the image forming apparatus related to a change in the velocity of the recording paper output from the output roller of the recording paper carrying section, the paper output velocity being a velocity at which the recording paper is sent from the image forming apparatus to the post-process apparatus, and thereafter increase the carrying velocity to a predetermined velocity stored in a memory which is in accordance with the paper output velocity, the image forming apparatus further comprising:

printing process generation detection means for detecting generation of one of the one-side printing and the two-side printing within a predetermined period stored in a memory while the post-process apparatus causes the carrying roller to continuously rotate and then stops the rotation after performing the other of the one-side printing and the two-side printing; and first change-of-paper-output-velocity prevention means for controlling the recording paper carrying section or both of the recording paper carrying section and the image forming section so that the paper output velocity does not change, when the printing process generation detection means detects generation of said one of the one-side printing and the two-side printing.

2. The image forming apparatus as set forth in claim 1, wherein when the one-side printing is carried out after the two-side printing, the first change-of-paper-output-velocity prevention means controls the recording paper carrying section so that recording paper for the one-side printing is switched back and output at a velocity identical with that of the two-side printing.

3. The image forming apparatus as set forth in claim 1, wherein when the one-side printing is carried out after the two-side printing, the first change-of-paper-output-velocity prevention means controls both of the image forming section and the recording paper carrying section so that printing is carried out in accordance with the two-side printing without an image to be formed on a back side of recording paper.

4. The image forming apparatus as set forth in claim 1, wherein when the two-side printing is carried out after the one-side printing, the first change-of-paper-output-velocity prevention means controls both of the image forming section and the recording paper carrying section so that the two-side printing is performed in such a manner that an order in which images are formed on front and back sides of recording paper is reversed such that the image to be printed on the back side of the recording paper is printed on the front side and the image to be printed on the front side of the recording paper is printed on the back side, and that the recording paper subjected to the two-side printing is switched back and output at a velocity identical with that of the one-side printing.

5. An image forming system, comprising an image forming apparatus and a post-process apparatus for performing a post-process on recording paper output from the image forming apparatus, the post-process apparatus comprising a carrying roller and a central processing unit, the post-process apparatus configured to temporarily stop the carrying roller of the post-process apparatus when changing a recording paper carrying velocity in the post-process apparatus in accordance with an instruction at the central processing unit received from a controller of the image forming apparatus related to a change in a velocity of the recording paper output from an output of the recording paper carrying section, the paper output velocity being a velocity at which the recording paper is sent from the image forming apparatus to the post-process apparatus, and thereafter increase the carrying velocity to a predetermined velocity stored in a memory which is in accordance with the paper output velocity, the image forming apparatus including:

an image forming section capable of two-side printing for forming images on both sides of the recording paper and one-side printing for forming an image on one side of the recording paper;

a recording paper carrying section comprising an inversion carrying route and an output roller, the recording paper carrying section for, in the two-side printing, outputting the recording paper from the output roller to the post-process apparatus without switching back the recording paper by the inversion carrying route, and for, in the one side-printing, switching back the recording paper by the inversion carrying route and thereafter outputting the recording paper from the output roller to the post-process apparatus, of the recording paper carrying section controller by a controller such that a velocity of the recording paper output from the output roller for the one-side printing is higher than that for the two-side printing;

printing process generation detection means for detecting generation of one of the one-side printing and the two-side printing within a predetermined period stored in a memory while the post-process apparatus causes the carrying roller to continuously rotate and then stops the rotation after performing the other of the one-side printing and the two-side printing; and first change-of-paper-output-velocity prevention means for controlling the recording paper carrying section or both of the recording paper carrying section and the image forming section so that the paper output velocity does not change, when the printing process generation detection means detects generation of said one of the one-side printing and the two-side printing.

* * * * *